United States Patent [19]

Marriott et al.

[11] Patent Number: 4,721,596

[45] Date of Patent: Jan. 26, 1988

[54] METHOD FOR NET DECREASE OF HAZARDOUS RADIOACTIVE NUCLEAR WASTE MATERIALS

[75] Inventors: Richard Marriott, Detroit, Mich.; Frank S. Henyey, San Diego; Adolf R. Hochstim, La Jolla, both of Calif.

[73] Assignee: Perm, Inc., La Jolla, Calif.

[21] Appl. No.: 613,013

[22] Filed: May 22, 1984

Related U.S. Application Data

[63] Continuation of Ser. No. 455,046, Jan. 3, 1983, abandoned, which is a continuation of Ser. No. 100,658, Dec. 5, 1979, abandoned.

[51] Int. Cl.[4] ..... G21G 1/02; G21G 1/06

[52] U.S. Cl. ..... 376/189; 376/169; 376/170; 376/184; 376/186; 376/158

[58] Field of Search ..... 376/184, 189, 158, 170, 376/146, 169, 186

[56] References Cited

U.S. PATENT DOCUMENTS

| | | |
|---|---|---|
| 2,837,475 | 6/1958 | Newson . |
| 3,175,955 | 3/1965 | Cheverton . |
| 3,255,083 | 6/1966 | Klahr . |
| 3,276,963 | 10/1966 | Pearce et al. . |

FOREIGN PATENT DOCUMENTS

| | | | |
|---|---|---|---|
| 620485 | 5/1961 | Canada | 376/158 |
| 2249429 | 5/1974 | Fed. Rep. of Germany . | |
| 802971 | 10/1958 | United Kingdom . | |
| 1035078 | 1/1960 | United Kingdom | 376/189 |

OTHER PUBLICATIONS

Nuclear Eng. Int., vol. 23, No. 266, 1/78, pp. 40–43, McKay.
Nuclear Technology, vol. 42, 1/79, pp. 34–50, Berwald et al.
Neclear Technology, vol. 42, 2/79, pp. 180–194, Parish.
Trans. ANS, 6/77, pp. 70, 71, Parish et al.
Trans ANS, 6/77, pp. 293, 294.
New Scientist, 7/77, pp. 14–16, Steinberg.
CONF-760622-3, "Actinide Transmutation Studies: A Review", Croff, 6/76, pp. 1–14.
BNWL-1900 (vol. 1), 5/74, Schreider et al, pp. 1.42–1.45, 1.67.
Huse et al, "Fusion-Fission Energy Systems: Some Utility Perspectives", ERDA-4, Dec. 3, 1974, pp. 27–61.
Tenney, "A Tokamak Hybrid Study," CONF-760733, pp. 71–80.
Rose et al, "Tokamak Antinide Burner Design Study", US-USSR Symposium of Fusion-Fission Reactors, Jul. 13–16, 1976, pp. 91–115.
"Alternatives for Managing Wastes From Reactors and Post-Fission Operations in the LWR Fuel Cycle", ERDA-76-43, vol. 4.
"A Radioisotope-Oriented View of Nuclear Waste Management", A. F. Rupp, ORNL-4476 (1972).
"A Re-Examination of the Permanent Disposal of Radioactive Waste", Marriott et al RIES 75-106 (1975).
"Advanced Waste Management Studies Progress Report 8, BNWL-B-223 (1973), Editor A. M. Platt.
"High Level Radioactive Waste Management Alternatives", BNWL-1900, vol. 4 (1974).
"Neutron-Induced Transmutation of High-Level Radioactive Waste", ORNL-TM-3964, H. C. Claiborne (1972).

*Primary Examiner*—Harvey E. Behrend
*Attorney, Agent, or Firm*—Schwartz, Jeffery, Schwaab, Mack, Blumenthal & Evans

[57] ABSTRACT

A method for decreasing the amount of hazardous radioactive reactor waste materials by separation from the waste of materials having long-term risk potential and exposing these materials to a thermal neutron flux. The utilization of thermal neutrons enhances the natural decay rates of the hazardous materials while the separation for recycling of the hazardous materials prevents further transmutation of stable and short-lived nuclides.

15 Claims, 38 Drawing Figures

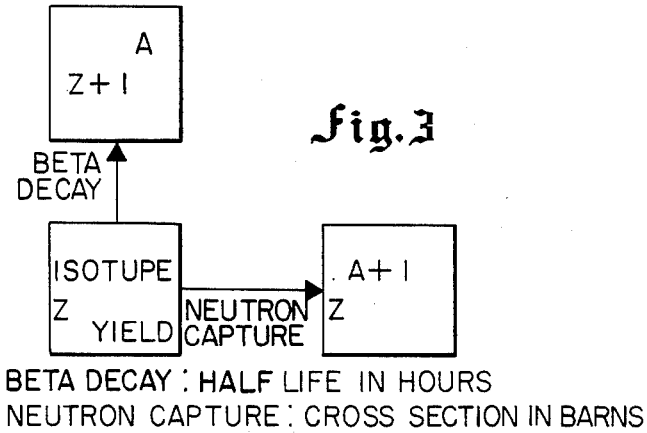
Fig. 3
Fig. 4
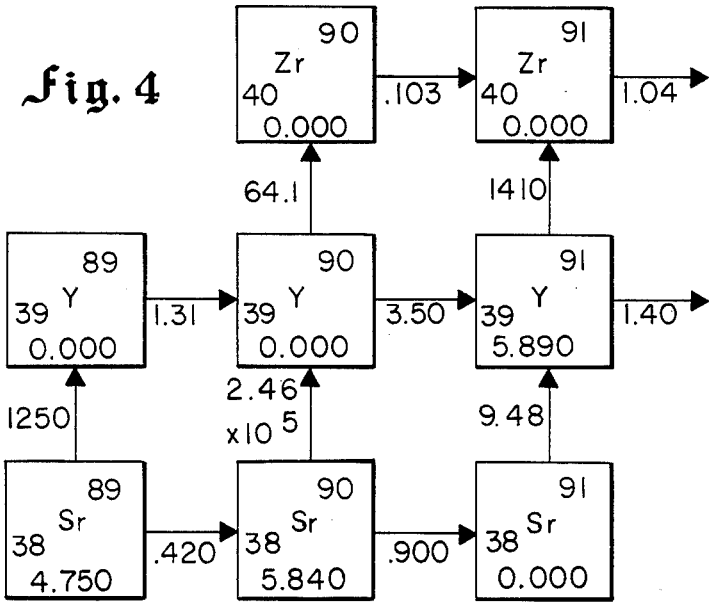

Fig. 5 TIME TO DECAY TO ACTIVITY OF HALF THAT OF $U^{238}$ AS A FUNCTION OF HALF LIFE. THE DOTS ON THE CURVE REPRESENT FISSION PRODUCTS

A PORTION OF THE DECAY / TRANSMUTATION CHAIN INCLUDING ISOTOPES OF CESIUM

METHOD FOR NET DECREASE OF HAZARDOUS RADIOACTIVE NUCLEAR WASTE MATERIALS

This applicatiion is a continuation of application Ser. No. 455,046, filed 1-3-83, now abandoned, which is a continuation of application Ser. No. 100,658, filed on Dec. 5, 1979, now abandoned.

BACKGROUND OF THE INVENTION

1. Field of the Invention

The invention is in the field of nuclear waste control and is particularly directed toward the elimination of long-lived radioactive nuclides of nulcear reactor waste.

2. Description of the Prior Art

The difficulties encountered in attempting to safely dispose of radioactive wastes generated by the fission process in nuclear reactors is probably the largest single cause of public resistance to the construction of nuclear power stations. A decade ago it was liberally estimated that 200,000 megawatts of nuclear generated electricity would be available by 1980. Today this expectation is down by one half. A major argument against permitting the further spread of nuclear power involves concern over methods proposed for disposal of the nuclear waste products. Present methods of disposal of nuclear waste, which may be in the gaseous, liquid or solid state consist either of dilution and dispersion or storage. In the first approach radioactive gases or liquids are diluted with large volumes of air or water to reduce the activity per unit volume to an allegedly safe level and released into the environment. In the second use, radioactive materials are stored in the containers in the ground or under the sea. With adequate safeguards, storage for about 30 years suffices to remove the harm from relatively short-lived radioactive nuclides, but the situation is quite different for the long lived wastes. Fortunately, the majority of the fission wastes have half-lives less than one year, which means that at worst they must be stored for 33 years to be reduced to $10^{-10}$ of their original amount. However, eighteen fission waste products as well as all the actinide waste products have half-lives greater than one year, but less than $10^{10}$ years, and it is these products that pose the long term storage problem. To ensure that long lived waste products are kept out of the biosphere until they become harmless—involving periods of hundreds of thousands or millions of years—present proposals involve burial in geological salt formations or other formations such as granite, quartzite, tuff (welded volcanic ash) and shale.

The burial solution to the waste problem is based on the assumption that the geological formation will remain stable for the necessary containment period. While this assumption is reasonable for plutonium, for example, it is not evident for the longer lived wastes including the fission products $Pd^{107}$, $Tc^{99}$, $I^{129}$, $CS^{135}$, and $Zr^{93}$, as well as the actinides.

In view of the extreme hazard that would be created if these materials were to be released into the biosphere, there is a strong and growing resistance to the "bury it and forget it" philosophy, and this opposition has now developed to the point of significantly slowing the growth of nuclear power. It is therefore most desirable if a method could be found to completely eliminate the noxious radioactive wastes from the environment.

Two methods have been suggested for such a final solution to the waste problem. Extraterrestrial disposal would permanently remove the wastes by transportation by rocket into the sun. Two major problems face this technique. First the cost, and second, but more significant, there is the possibility of vehicle failure within the atmosphere leading to a highly dangerous level of radioactive contamination.

A more attractive technique involves the direct transmutation of the dangerous waste materials by neutron bombardment into innocuous materials, or at worst short lived radioactive species. Such a transmutation can be achieved, for example, by recycling waste products back into the reactor which produced them. Such nuclear transformations have been discussed in the literature but have been found only applicable for effective elimination of the actinides produced by neutron capture, e.g., "Advanced Waste Management Studies Progress Report", 8, BNWL-B-223 (1973); H. C. Claiborne, "Neutron Induced Transmutation of High-Level Radioactive Wastes", ORNLTM-3964, 1, 24; and "High-Level Radioactive Waste Management Alternatives", 4, 9, BNWL 1900 (1974). The applicability of transmuting long-lived fission products as well as the actinides by neutron capture in reactors has not been regarded as practical since such a procedure reputedly produces more long term waste than it removes.

SUMMARY OF THE INVENTION

It is therefore a general object of the invention to reduce to amount of radioactive waste and in particular fission products in nuclear reactors so that time storage requirements may be reduced from those required for natural radioactive decay.

The invention may be characterized as a method of increasing the rate of transmutation of radioactive nuclear waste materials in excess of their natural decay rates for the more rapid conversion to stable nuclides.

The method comprises the steps of (a) extracting the nuclear waste from the reactor fuel, either continuously or periodically, (b) separating the waste into selected components of different constituents, (c) storing those components composed of stable nuclides or of short lived nuclides which naturally decay into stable nuclides, (d) exposing those components containing long lived high risk potential nuclides to a high flux of thermal neutrons in order to induce nuclear transmutations, (e) further separating of the waste after exposure to the neutrons, and repetition of steps c, d, and e for transmutation of the long lived radioactive waste into stable nuclides, or to short lived nuclides which rapidly decay to stable nuclides.

BRIEF DESCRIPTION OF THE DRAWINGS

These and other objects of the invention will become clear in relation to the following specification taken in conjunction with the drawings wherein:

FIG. 3 is an illustration of the format utilized to deposit the decay/transmutation chain in general;

FIG. 4 illustrates a proton of the decay/transmutation chain for a specific nuclide;

DETAILED DESCRIPTION OF THE PREFERRED EMBODIMENTS

Overview

As used herein, the term transmutation may be defined as the change of one nuclide into another nuclide of the same or a different element by any nuclear process, natural or artificial. A beneficial transmutation can be defined as any transmutation which leads, or is part of a sequence of transmutations which leads, in a reasonably short time, from a long lived radioactive nuclide to a stable nuclide.

In accordance with the principle of the invention, radioactive waste materials are re-cycled in a region of a high-flux of thermal neutrons to permit neutron induced transmutation. Chemical and/or physical and/or isotope separation of the waste may be performed both prior to and/or after neutron irradiation. This separation has several benefits:

1. It minimizes the waste of neutrons which would occur in the nonbeneficial transmutation of a stable nuclide into another nuclide.

2. It minimizes the production of long-lived radioactive nuclides from transmutation of stable nuclides.

3. It minimizes the amount of material that has to be handles in the exposure to the high flux.

4. It maximizes the beneficial use of the available neutrons in reducing the radioactive waste hazard.

Figure 1:
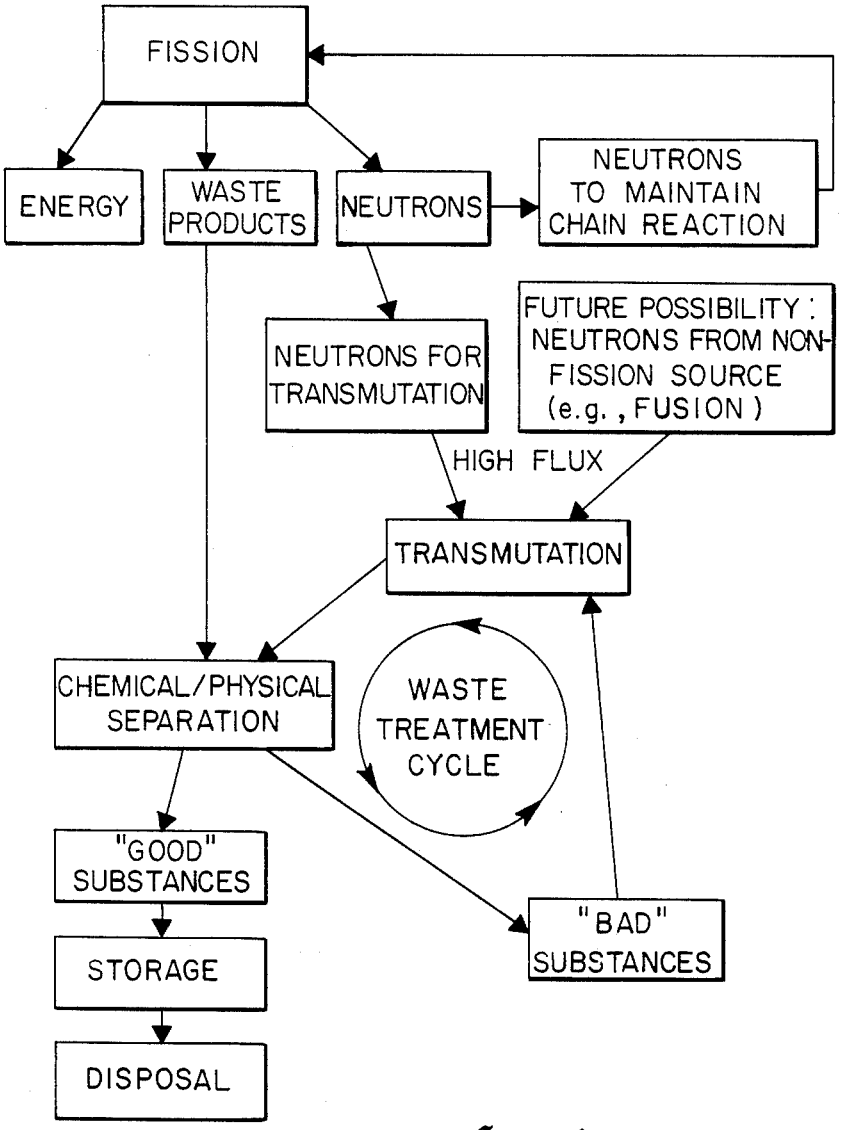
FIG. 1 is a block diagram of the overall waste transmutation method and system in accordance with the invention.

A block diagram of the process in accordance with the invention is shown in FIG. 1. $U^{235}$ or other fissile material undergoes fission, splitting into various fission fragments and producing neutrons. Some of these neutrons are used up in maintaining the chain reaction, while others are used in transmuting the waste. The waste products, including the fission fragments and actinides produced by neutron irradiation of Uranium, Plutonium, and/or Thorium, are separated into various components, each component comprising one or more different elements of the waste nuclei. This separation is either chemical or physical or a combination of the two and may further include isotope separation. In principle, isotope separation, as for example employing a mass spectrometer, could be utilized for separation of all isotopes. Economic considerations would, however, dictate primarily a combination of chemical and physical processing. Those "good" components which include only short-lived and stable elements and which do not include long-lived hazardous radioactive substances are stored to allow the decay of short-lived substances. Those "bad" components containing long-lived radioactive substances are exposed to a high flux of neutrons in order to induce transmutation. After a certain amount of exposure, these wastes are recycled through the separation/irradiation loop.

The high neutron flux may be produced by any of a number of methods that are often referred to as flux-trapping. These methods allow the flux in some regions of the fission reactor to be significantly higher than in other parts, making use of the strong decrease of cross sections of increasing neutron energy from thermal to MeV regime neutrons. Flux-trap reactor designs are described in, for example, U.S. Pat. Nos. 3,255,083, 3,341,420; 3,276,963; 3,175,955; and 2,837,475.

Figure 2:
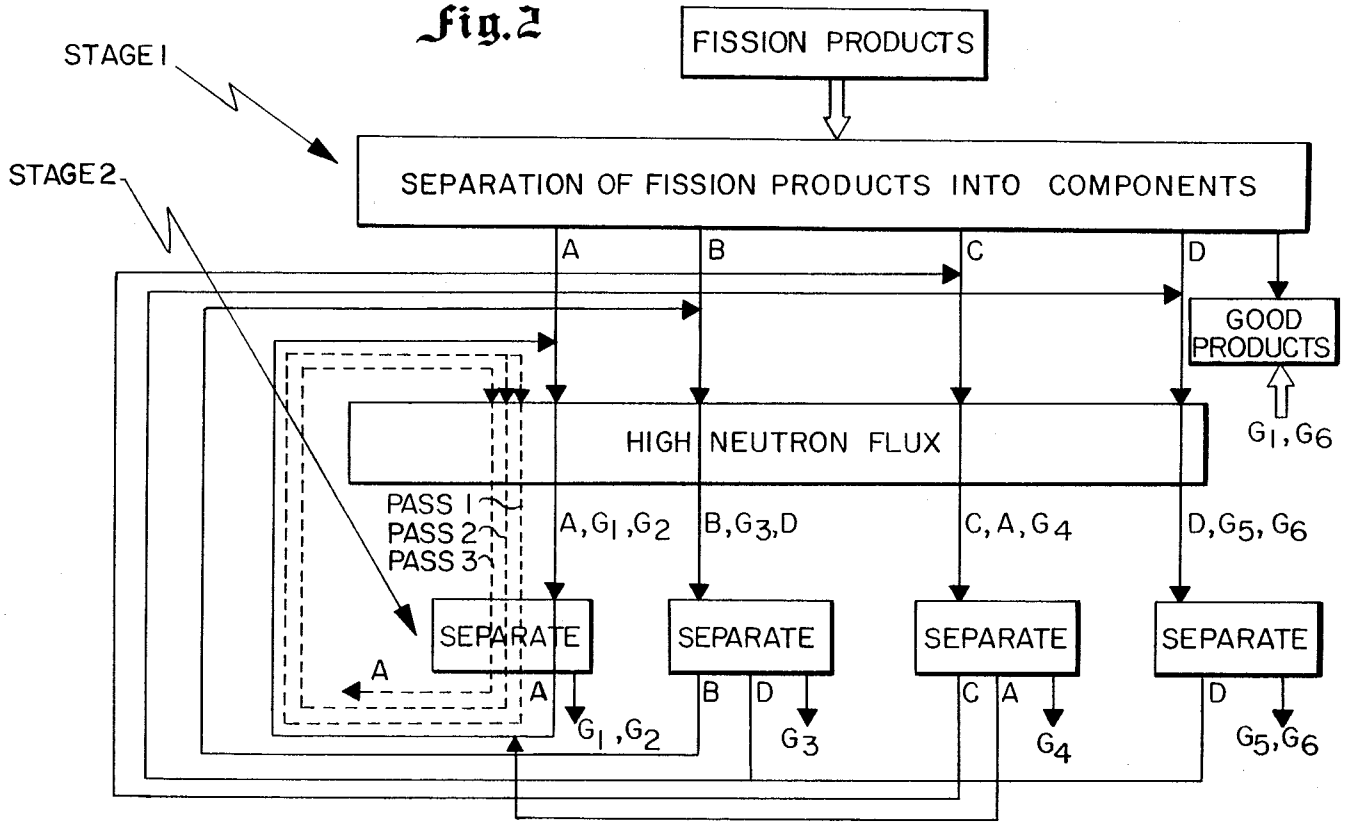
FIG. 2 is a block diagram of a preferred embodiment of the separation/irradiation treatment cycle.
Figure 5:
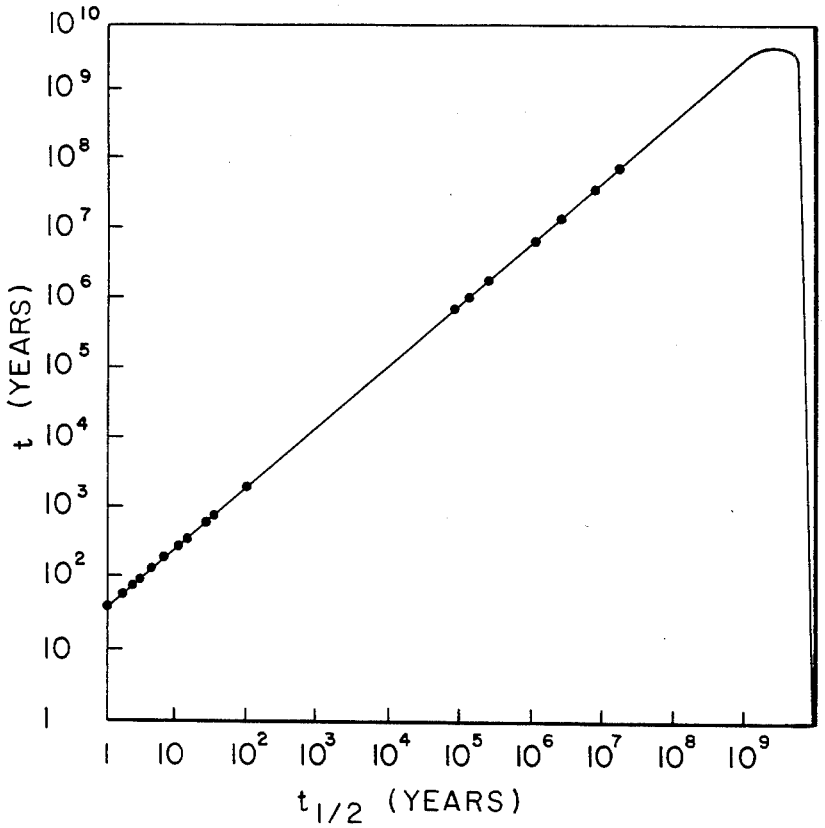
FIG. 5 is a chart of the fission fragment decay times as compared to one-half the decay activity of $U^{238}$.

Alternatively, the high flux may, in the future, be produced independently of fission reactors, most notably by fusion reactors. In this case economy of reaction utilization is not critical as copious supplies of neutrons can be produced with little accompanying radioactive waste. FIG. 1 illustrates the inventive method generally.

Where reaction economy is an important factor i.e., fission produced sources, the preferred chemical/physical separation techniques is to be carried out as a two-stage process as illustrated in FIG. 2.

In stage 1, reactor products are separated into components designated, for the sake of illustration, A, B, D, and D. Each component, once separated is maintained in a separate channel isolated from other components and fed to the high flux region. After transmution in the high flux region the output of any given channel will generally contain some smaller amount of the original component remaining together with additional elements. These additional elements may be "good" products designated $G_1$, $G_2$. . . $G_6$, or other components which are long-lived and require futher processing. The original component of each channel is thus separated in stage 2 from these additional elements as illustrated in FIG. 2. The recycling then occurs from the output of the stage 2 separation to the high flux region. Isotope separation may be part of stage 1 and/or stage 2 separation. Further, a specific rest stage may be provided before and/or after exposure to the neutron flux to permit $\beta$ decay where desired prior to further neutron exposure.

The choice of separation/irradiation strategies depends, in addition to economic and chemical considerations, on the transmutations possible. FIG. 3 shows a general format utilized in describing the decay/transmutation sequence and FIG. 4 illustrates, as an example, a portion of a chart of some nuclides illustrating the transmutation possibilities. Natural $\beta$ decay transmutations change a nuclide into another shown directly above it, while artificial neutron induced transmutations take a nuclide into another immediately to the right. $\alpha$ and $\beta+$ decay are not significant, and for simplicity, only one isomer of each nuclide has been considered. The values shown on the vertical lines connecting nuclides are the half-life of the transmutation in hours, while the values on the horizontal line are neutron cross-sections in barns.

Fission yields per 100 fissions are also given in the chart. The direct fission yield is almost completely to neutron rich nuclides not shown, which would occur below those shown. These neutron rich nuclides rapidly undergo a series of $\beta$ decays, as tabulated by Rose, P. F. and Burrows, T. W., ENDF/B *Fission Product Decay Data,* August 1976, BNL-NCS-50545 (ENDF-243), to those nuclides which are illustrated on the chart. The yield shown on the charts of FIGS. 3 and 4 is therefore the same yield as the direct fission products of the same atomic weight. The document *Permanent Elimination of Radioactive Wastes by Nuclear Transmutation,* Physical Dynamics, Inc. PD-LJ-79-204, August, 1979 by Frank S. Henyey, the whole of which is incorporated herein by reference, gives further details of the assumptions and computer analysis given herein.

$Sr^{90}$ is a long-lived radioactive nuclide which is desired to be removed. Therefore, the transmutation from $Sr^{90}$ to $Sr^{91}$ is a beneficial transmutation. $Sr^{91}$ naturally transmutes in a short time to stable $Zr^{91}$. On the other hand, the other neutron induced transmutations shown are not beneficial and must be minimized by choice of the separation/irradiation loop. $Y^{89} \rightarrow Y^{90}$, for example, does not involve long-lived nuclides at all and therefore the induced neutron transformation simply wastes neutrons. $Sr^{89} \rightarrow Sr^{90}$ not only wastes neutrons but also produces a long-lived nuclide. As described more fully hereinafter, the $Sr^{89}$ is allowed to naturally transmute to $Y^{89}$ prior to insertion of Sr into the high neutron flux region. Y is then chemically separated from the Sr to prevent its otherwise neutron usage, and the Sr is exposed to the high neutron flux to transmute to $Sr^{90}$ to $Sr^{91}$.

Table 1 lists 18 long-lived radioactive fission products of concern. These "bad" nuclides are broken-up into two groups, the first group having half-lives less than 100 years, and the second group having half-lives greater than 30,000 years. In addition, there are actinide wastes not listed. In reference to FIG. 2, there may be up to 18 separate separation/irradiation loops for the fission products and an appropriate number of loops for the actinides, one loop for each substance.

The "bad" nuclides considered for elimination are listed in Table 1 and are defined primarily by the amount of radioactivity they are responsible for in the waste, after the waste has been stored for a certain length of time. Their half-life is not too long, else they provide very little radioactivity. Their half-life is not too short, else they decay during the storage period. They must be present, or at least have the possibility of being present, in a sufficiently high concentration to contribute significant radioactivity.

With these qualitative criteria in mind, the following somewhat arbitrary quantitative definition of a bad fission product nuclide is utilized:

1. Its half life is greater than 1 year;
2. Its half life is less than $10^{10}$ years;
3. Its atomic weight is between $A=72$ and $A=167$, since these are the limits of fission product compilations, and the yields outside this range are below the part per billion level.
4. It is descended from neutron-rich nuclear species by either (a) $\beta$ decays or (b) a combination of $\beta$ decays and neutron absorptions. However, $\beta$ decay chains through nuclides of half life greater than $10^4$ years are not considered. Exceptions to this rule are present at the 10 parts per billion level in the waste.
5. The excited states $Sn^{121m}$, $Ho^{166m}$ and $Cd^{113m}$ are excluded.

A conservative level of activity at which a substance can be considered nearly safe is half the activity of an equal amount of $U^{238}$. This criterion is in agreement with the cutoff in half lives of $10^{10}$ years, twice the half life of $U^{238}$ (and also twice the age of the Earth). The required storage time as a function of half life is shown in FIG. 3, with the bad nuclides indicated by dots. For our one-year cutoff in half life, this criterion requires a storage time of 33 years. The lower group of bad nuclides requires up to 3,000 years of storage, while the upper group requires at least a million years for every nuclide in that group, and up to 1/30 the age of the earth.

Preliminary Theoretical Considerations

The transmutation process must satisfy at least three criteria: (1) it must consume less energy than was produced when the waste was created. (2) it must generate of itself less hazardous waste than that destroyed, and (3) it must eliminate waste materials at a rate significatly greater than their natural decay rate. Previous studies reported in ERDA-76-43, vol: 4 indicate that only neutron absorption processed can satify the first criterion. The major source of neutrons at present are the fission power reactors themselves. Therefore the issue of the second criterion is whether the number of neutrons produced in the power reactor is sufficient to transmute all or a substantial amount of the long lived waste produced along with those neutrons. The employment of chemical and/or physical separation of waste contained in this invention is aimed primarily toward the satisfaction of the third criterion. In the case of the actinides, both as a consequence of their large neutron capture probabilities and because their final removal by fission is accompanied by regeneration of some of the neutrons absorbed, all three criteria can be met. However, when the fission wastes are included, earlier studies cited above, not incorporating the principles of the invention, concluded that the second and third criteria could not be met. The invention is directed toward meeting all three criteria.

Production of Safe Waste Products

With regard to the second criterion, it is convenient to perform the transmutation in the power reactors themselves. Fission of an average U-235 nucleus generates a certain amount of waste and a certain number of neutrons. The question in satisfying the second criteria reduces to whether these neutrons are sufficient to transmute the waste produced.

Figure 6:
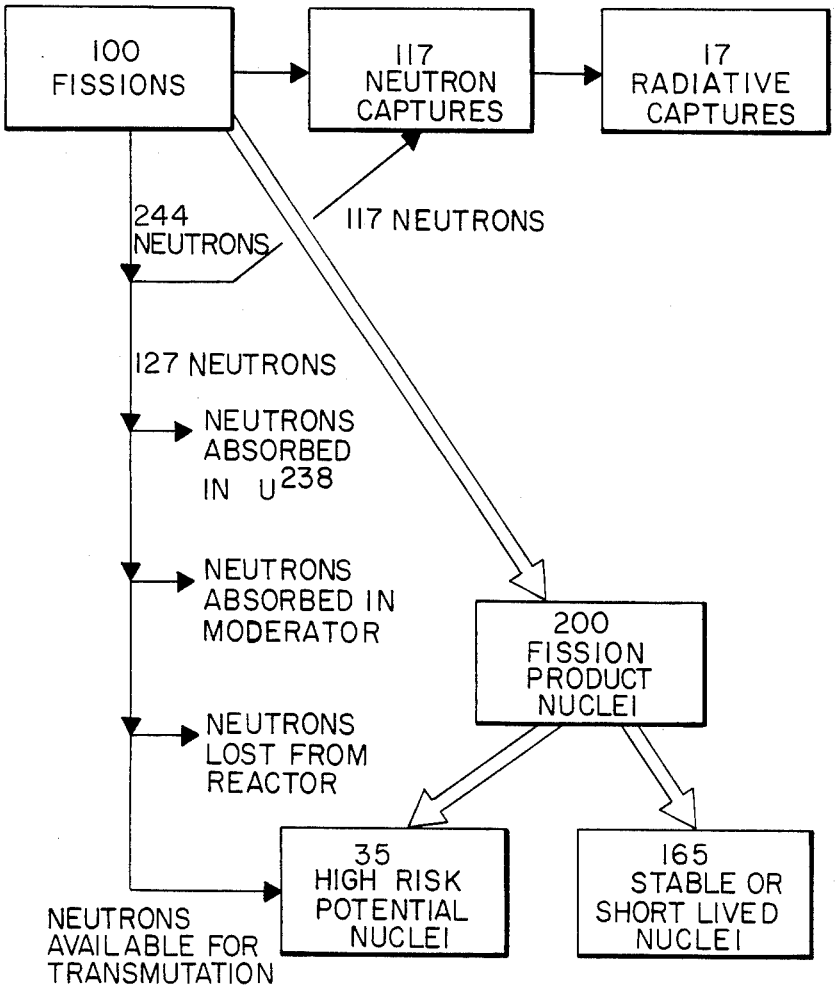
FIG. 6 is a block diagram illustrating neutron economy in the fission reactor process.

More specifically, one may consider the fate of the neutrons produced from 100 fissions of $U^{235}$, as illustrated in FIG. 6. All neutrons are considered to be thermalized. Of the 244 neutrons produced, 117 are required to maintain the chain reaction, causing 100 additional fissions and 17 absorptions without fission. The remaining 127 neutrons are absorbed in various ways including being absorbed in $U^{238}$, producing actinide waste and ultimately more fission waste, and being absorbed in the moderator and structure of the reactor. Those remaining are available for waste transmutation. Of the 200 fission products there are 35 long-lived radioactive nuclei (plus those from fission of Plutonium and actinide wastes). This waste requires at least 35 of the, at most, 127 neutrons in order to accomplish the transmutation. Without the principles of the invention, many more than 35, and even more than 127, neutrons will be required.

To establish whether there are sufficient neutrons to eliminate the associated waste products, it is necessary to study the transmutation-decay chain information on all nuclides which are placed in the high flux region. The most important such nuclides are the isotopes of those elements including the long-lived radioactive fission products of which the eighteen most important radioactive nuclides are listed in Table I. The nuclide symbol and half-life are listed in the first two columns. The cross sections which determine the neutron-induced transmutation rates are listed in the third column. The approximate amounts (per 100 fissions) in the nuclear waste is given in column 4. Column 5 gives the name of the element.

A computer program, WASTE, listed in appendix A was utilized to study the chains for all eighteen fission waste products. This program constructs a solution of a large set of coupled differential equations describing the transmutations. The form of these equations is that the time rate of change of any nuclide is equated to a sum of up to four terms as follows:

1. The decrease of the nuclide by natural decay.
2. The decrease of the nuclide by neutron-induced transmutation into another nuclide.
3. The increase of the nuclide from natural decay of another nuclide.
4. The increase of the nuclide from neutron-induced transmutation of another nuclide.

The computer program further allows initial separation and periodic separation between exposures to a high thermal neutron flux. A strategy for each nuclide is presented which is sufficient to meet the three criteria for successful transmutation.

In utilizing fission reactors, it is possible that (1) each reactor is responsible for precessing its own waste or (2) several "power" reactors send their waste to one "transmutation" reactor. In as much as neutrons are in short supply, and the second alternative is most probably not viable since it wastes the neutrons. The first possibility, of course, allows the exchange of waste between different reactors; one, for example, might handle all the cesium while another handles all the zirconium, with appropriate design differences between the reactors. The important consideration is that neutrons not be wasted.

Equation for Transmutation

An given nuclide, which we label by its atomic weight A and its atomic number Z, may undergo $\beta$ decay to the nuclide (Z+1, A) or it may undergo neutron absorption to the nuclide (Z, A+1). The rate constants for these processes are $\alpha_{Z,A}=\ln 2/T_{Z,A}^{(\frac{1}{2})}$ and $\sigma_{ZA}\phi$ respectively where $T_{ZA}^{(\frac{1}{2})}$ is the nuclides half life and $\sigma_{ZA}$ is its neutron absorption cross section, while $\phi$ is the effective flux. Thus the amounts $N_{Z,A}$ of the nuclides obey the set of differential equations $$\frac{dN_{Z,A}}{dt} = -(\alpha_{Z,A} + \sigma_{Z,A}\,\phi)\,N_{Z,A} + \alpha_{Z-1,A}\,N_{Z-1,A} + \sigma_{Z,A-1}\phi\,N_{Z,A-1}$$

The first two terms determine the loss of the nuclide due to its decay and neutron absorption while the last two terms determine its gain due to the decay or transmutation of other species.

The solution of this equation has the form $$N_{Z,A}^{(t)} = \sum_{\substack{Z'\leqq Z\\ A'\leqq A}} C_{Z,A;Z',A'}\, e^{-\lambda_{Z',A'}t}$$

where $\lambda_{Z',A'}=\alpha Z_{Z',A'}+\sigma_{Z',A'}\phi$ and the C's are determined by the initial amounts and by substituting this solution into the differential equation.

In detail, the C's are given by:

(1) For Z,A not both equal to Z',A'

$$C_{Z,A;Z',A'} = \frac{1}{\lambda_{Z',A'}}\left[\alpha_{Z-1,A}C_{Z-1,A;Z',A'} + \sigma_{Z,A-1}\phi C_{Z,A-1;Z',A'}\right]$$

(where C's which don't obey the conditions $Z'\leqq Z, A'\leqq A$ are zero).

(2) For Z,A=Z',A'

$$C_{Z,A;Z,A} = N_{Z,A}(t=0) - \sum_{(Z',A')\neq(Z,A)} C_{Z,A;Z',A'}$$

These substitutions are carried out in order of increasing Z and increasing A. Thus the lowest nuclide in a chain, which will occasionally be a bad isotope, has its amount decreased following an exponential curve:

$$N_{Z_0,A_0}(t) = N_{Z_0,A_0}(0)\, e^{-(\alpha_{Z_0,A_0}+\sigma_{Z_0,A_0}\phi)t}$$

The effective half life for removal is $$T_{eff}^{(\frac{1}{2})} = \frac{\ln 2}{\alpha_{Z_0,A_0} + \sigma_{Z_0,A_0}\phi}$$

These effective half lives of the bad nuclides are compared to the natural half life in Table 2. The effective flux is taken to be $10^{16}$ neutrons/cm$^2$ sec.

Another case of importance is that of a nuclide which as a lower nuclide in the chain with a smaller value of $\lambda$. Let us take, for example, a nuclide (Z,A) accompanied by a lighter isotope (Z, A−1) such that $\lambda_{Z,A-1}<\lambda_{Z,A}$.

Then the solution $$N_{Z,A}(t) = C_{Z,A;Z,A}\, e^{-\lambda_{Z,A}t} + C_{Z,A;Z,A-1}\, e^{-\lambda_{Z,A-1}t}$$

will approach, for large $t$ $$N_{Z,A}(t) \rightarrow C_{Z,A;Z,A-1}\, e^{-\lambda_{Z,A-1}t}$$

so that the ratio $$\frac{N_{Z,A}(t)}{N_{Z,A-1}(t)} \rightarrow \text{constant.}$$

This constant is evaluated by substitution into the differential equation, and found to be $$\frac{N_{Z,A}(t)}{N_{Z,A-1}(t)} \rightarrow \frac{\sigma_{Z,A-1}\phi}{\lambda_{Z,A} - \sigma_{Z,A-1}\phi}$$

In the cases considered below, neutron absorption dominates $\lambda_{Z,A}$ and $\sigma_{Z,A} >> \sigma_{Z,A-1}$, so this equilibriun ratio becomes the ratio of cross sections $$\frac{N_{Z,A}(t)}{N_{Z,A-1}(t)} \rightarrow \frac{\sigma_{Z,A-1}}{\sigma_{Z,A}}$$

This establishment of equilibrium also applies to longer chains. This effect is important for $Kr^{85}$, $Zr^{93}$, $Pd^{107}$, and $Sm^{151}$, as is discussed below.

Overview of Results

The transmutations of the 18 bad isotopes have been analyzed for periods of up to about 100,000 hours (about 11½ years of irradiation in a flux of $10^{16}$ neutrons/cm$^2$ sec. From Table 2, one can see that this time period ranges from orders of magnitude more than enough time to remove a nuclide to less than one half-life. The improvement of removal rate over natural decay varies from a few percent to a factor of over $10^8$.

Two types of ideal cases may be considered, one with perfect isotope separation being carried out frequently before and during the separation/irradiation cycles and one with perfect chemical separation being carried out periodically. Clearly, the more separation that can be accomplished, the more efficient is the transmutation. The isotope separation provides an absolute optimum situation, and provides a measure of the inefficiency of chemical separation. For the case of chemical separation, two possibilities are treated for some waste components. In the first case, it is assumed that there is control over the time between fission and chemical separation. This situation is possible in liquid fission fuel reactors where the fuel and waste may, for example, be continuously cycled without shut-down of the reactor. In the second, the time between fission and separation is assumed long, as for example, in solid fuel fission reactors. The extra control allows one to separate nuclides which would otherwise decay into another element.

Table 3 shows the results of the computer analysis for chemical separation and for isotope separation. The two cases of chemical separation are labeled a and b for separation with and without timing respectively. Th table is ordered by increasing half life and divided into the first and second groups previously defined in relation to Table 1.

A very rough measure of the hazard of nuclear waste is the total amount of each of the two groups of bad nuclide. (This measure neglects differences in biological activity, in ease of storage (i.e., geochemical effects, in half life within a group, and in the nature of the radiation emitted). The waste starts with about 15 atoms per hundred fissions for the low group and 20 atoms of the high group.

With isotope separation, after the processing of each nuclide for a length of time somewhat appropriate for the nuclide, but for less than 12 years, 4 atoms of the low group and 0.2 atoms of the high group remain. If the processing (with isotope separation) were to continue up to 12 years, half the $Cs^{137}$ (3.1 atoms), a small amount of $Sr^{90}$ (0.14 atoms) and traces of $Ru^{106}$, $Sb^{125}$, and $Kr^{85}$ would remain in the lower group. Other sizable numbers in the table result from the short time of processing imagined. The high group would contain a small amount of $Sn^{126}$, an amount of $Se^{79}$ depending on its cross section but less than 0.055 atoms, and a trace of $Zr^{93}$. All other bad nuclides would be removed. About 32 of the up to 127 neutrons would be used.

With chemical separation only there are a number of sigificant differences. After processing, there are in addition 0.0014 atoms of $Sb^{125}$, 0.06 atoms of $Kr^{85}$, and 0.013 atoms of $Sm^{151}$ remaining in the lower group, and a considerable amount (0.5 to 0.86 atoms) of $Zr^{93}$ and 0.035 atoms of $Pd^{107}$ remaining in the upper group. The neutron usage has increased from 32 up to 47 or 74 neutrons, from 12 to 20 in the lower group and from 20 to 27 or 55 in the higher group. The 8 extra neutrons in the lower group have been used about 4 for $Pm^{147}$, and about 1 each for $Eu^{155}$, $Kr^{85}$, and $Sm^{151}$. In the upper group the extra neutrons have been used largely by $Zr^{93}$, even in case a, and by $Cs^{135}$ if case b holds. $Pd^{107}$ has also used up an extra neutron.

It is to be noticed that case a of $Cs^{135}$ (discussed in detail below) is even superior to isotope separation, due to the tiny amount of processing time required.

With chemical separation only there is another important consideration. For a number of the elements with bad isotopes, there are stable isotopes with a smaller cross section than the bad isotope. As separation/irradiation goes on, the bad isotope is depleted while the level of stable isotopes remains high. In five cases, listed in Table 4, a significant amount of stable isotopes remain after a reasonable amount of processing. The amount of bad isotope is listed and the number of neutrons that would be wasted in completely transmuting all of the stable isotopes. This amount is most significant for $Zr^{93}$, even though the more favorable case was chosen (i.e., case a). The ratio of extra neutrons to bad isotope remaining is the largest in the case of $Sm^{151}$, in which it requires over a thousand nuetrons to convert the good Samarium in order to remove one atom of the bad.

If the large number of neutrons required are not available, then the remaining amounts of these elements, containing the remaining bad isotope, have to be disposed of, and the bad isotope remains a hazard. As the high neutron flux exposure goes on, different lots of these elements at different degrees of depletion of the bad isotope may be kept isolated from one another. This process maya be accomplished by a spiral-type channel arrangement shown in FIG. 2 by the dotted lines in reference to component A.

On the other hand, the remaining elements, most notably the large amount of $Cs^{137}$, can have partially processed part of the element combined with the part of that element freshly separated from the recent fission waste, as indicated by the solid lines in FIG. 2.

The greatest advantage of isotope separation would occur for $Zr^{93}$, which wastes a large number of neutrons and which has a very significant amount of $Zr^{93}$ left with the stable isotopes of Zirconium after a reasonable amount of processing has taken place. Isotope separation is significant for Cesium unless case a is utilized, because of the large number of neutrons needed. Isotope separation is also useful for $Sr^{90}$ and for the other elements on Table 4 if the amounts remaining are considered objectionable, and depending on the required neutron economy could be useful for those elements which require extra neutrons.

INDIVIDUAL ELEMENTS

Each element was studied by computer runs utilizing the program WASTE shown in the appendix. Perfect chemical separation processing has been assigned for each channel with respect to all elements not originally in the channel.

The bad nuclides are discussed in order of increasing atomic number and increasing atomic weight. It is noted that in developing a strategy for each individual bad nuclide, there is no interdependency between the individual bad nuclides except in the case of $Pr^{147}$ and $Sm^{151}$.

$Se^{79}$

Figure 7A:
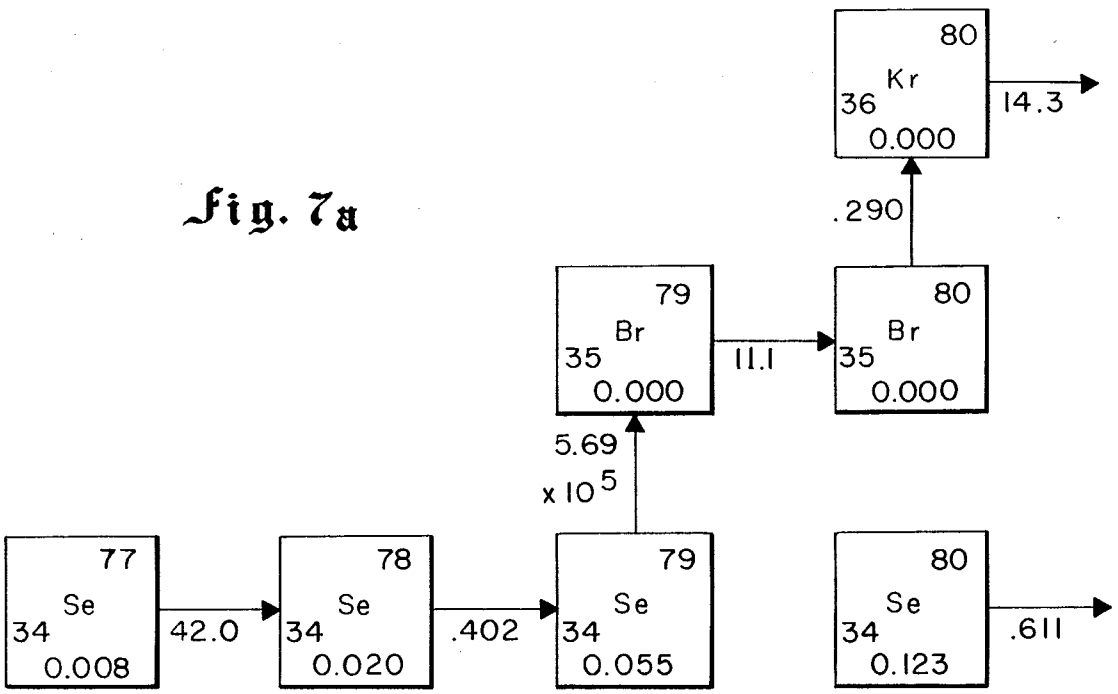
FIG. 7 represents the decay/transmutation chain for $Se^{79}$.
Figure 7B:
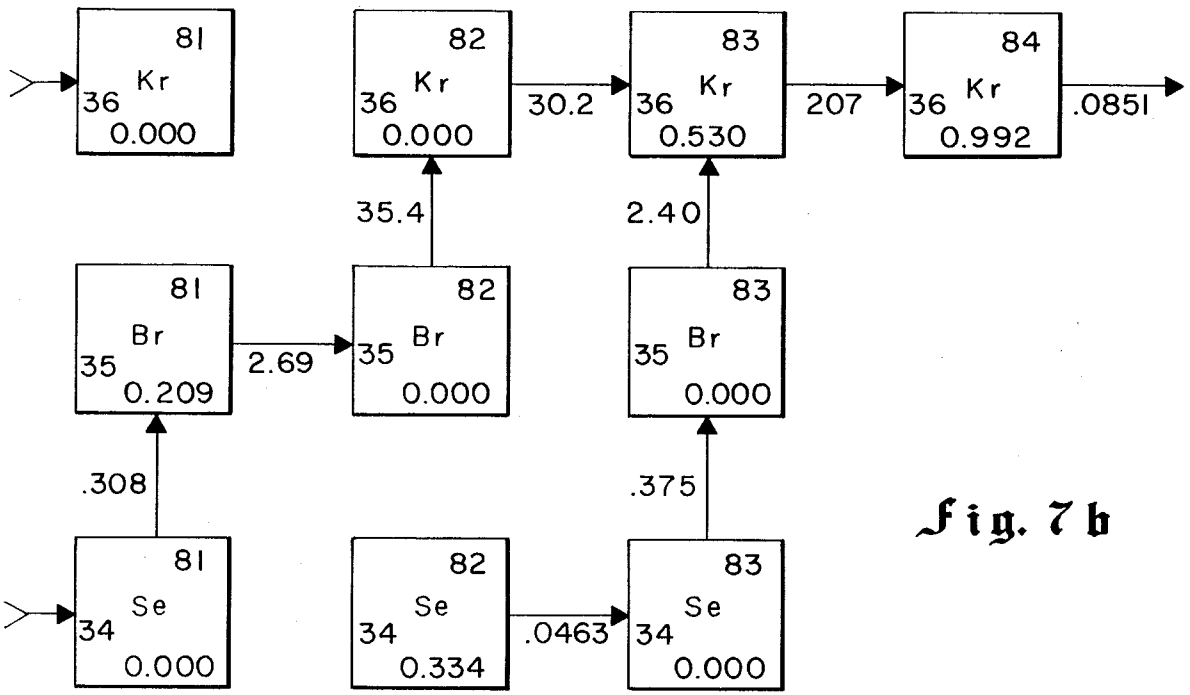

The decay/transmutation chain for $Se^{79}$ is shown in FIG. 7. The thermal neutron absorption cross section for $Se^{79}$ is not reported (probably owing to its low abundance) and may be assumed small. Thus one may assume that no significant reduction of this isotope is possible. If however the neutron absorption cross section is found to be significant, the separation/irradiation process may be utilized with Br and Kr removed periodically to enhance neutron economy.

$Kr^{85}$

Figure 8A:
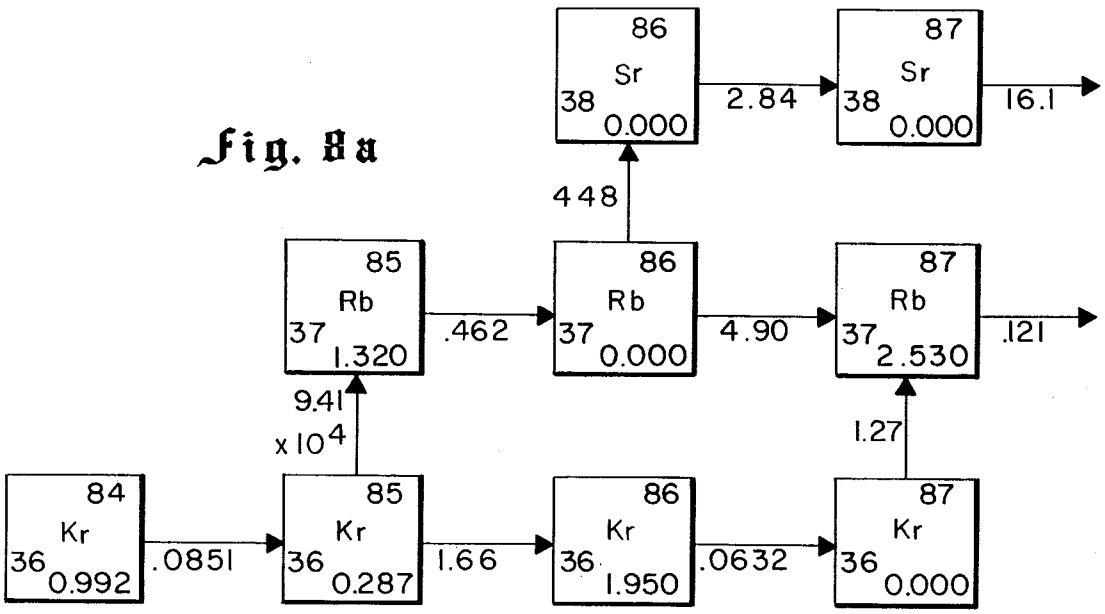
FIG. 8 represents the decay/transmutation chain for $Kr^{85}$ and $Sr^{90}$.
Figure 8B:
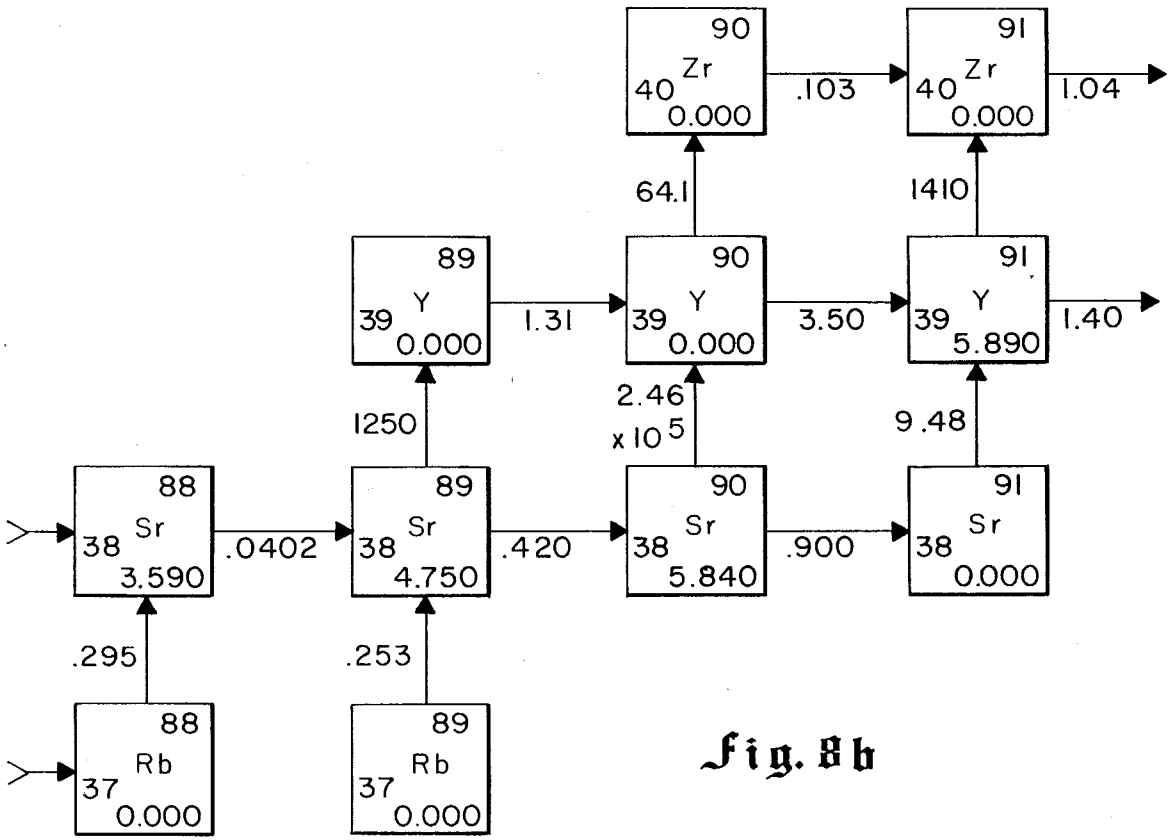
Figure 9:
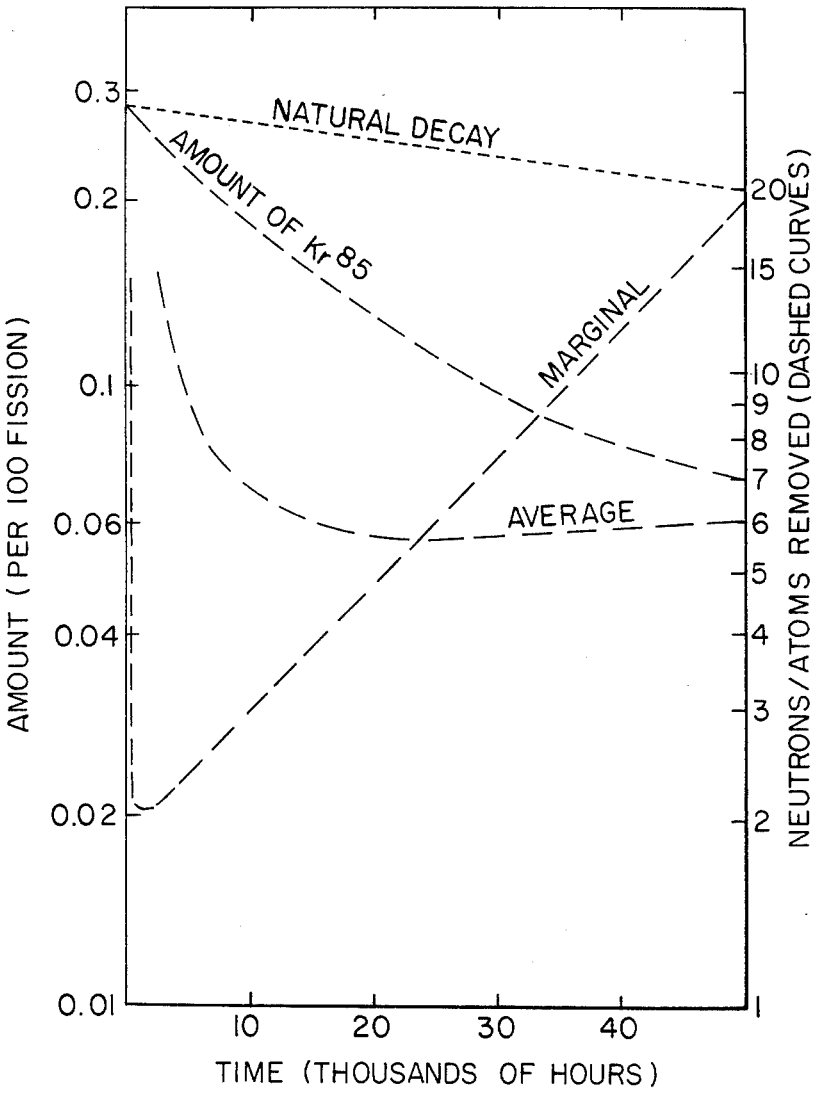
FIG. 9 is a chart showing the removal of $Kr^{85}$ as compared to its natural decay.

FIG. 8 shows the decay/transmutation chain for $Kr^{85}$. Only about 20% of the A=85 waste ends up as radioactive $Kr^{85}$. The remainder ends up as $Rb^{85}$, because the rapid $\beta$ decay chain passes through an excited isomer of $Kr^{85}$ which $\beta$ decays to $Rb^{85}$. As a result, there is considerably more of the stable isotopes $Kr^{83}$, $Kr^{84}$, *and* $Kr^{86}$. $Kr^{83}$ has by far the largest neutron absorption cross section. $Kr^{84}$ and $Kr^{86}$ each have a cross section about 1/20 of $Kr^{85}$.

When the Kr is subject to the neutron flux $Kr^{83}$ is converted into $Kr^{84}$. At this point the ratio of $Kr^{84}$ to $Kr^{85}$ is about 5. This ratio cannot exceed 20 (the ratio of the cross sections of $Kr^{85}$ and $Kr^{84}$). Therefore, after about 75% of the $Kr^{85}$ has been transmuted, it becomes difficult to convert any more $Kr^{85}$. For every 20 atoms of $Kr^{84}$ converted to $Kr^{85}$, only 21 are converted to $Kr^{86}$. Meanwhile about 30 $Kr^{86}$'s are transmuted. Thus it takes about 70 neutrons to gain 1 $Kr^{85}$.

The results of the actual calculation is shown in FIG. 9 to 48,000 hours (somewhat over 5 years) at which time 75% of the $Kr^{85}$ is gone. At about this time, the natural decay of $Kr^{85}$ actually removes it faster than continuted exposure to neutrons. Only isotope separation would improve matters. FIG. 4 also shows the removal of $Kr^{85}$ as compared to its natural decay. Also shown are the average and marginal usage of neutrons showing the effects of $Kr^{83}$ at very small times and $Kr^{84}$ at large times. Different scales are used for amounts and neutron usage.

Thus it is reasonable to reduce $Kr^{85}$ to a level 2 or 3 times lower than natural decay would give, and no further except with isotope separation. In order to conserve neutrons it was assumed that all the decay/transmutation products, i.e., Rb and Sr were completely separated from Kr after each irradiation step was completed. The gas Kr may be readily separated from these solid products.

$Sr^{90}$

Th decay/transmutation chain for $Sr^{90}$ is also shown in FIG. 8. $Sr^{90}$ is transmuted according to the exponential law, since the only other isotope of Strontium in the waste is stable $Sr^{88}$ which transmutes to $Sr^{89}$ with a very small cross section. $Sr^{89}$ is initially present in the waste (as well as being produced from $Sr^{88}$), but it decays with a half life of 1250 hours, short compared to the relevant time scale for the transmutation of $Sr^{90}$.

The program WASTE was utilized with chemical processing every 3000 hours. No indication of undesirable effects of the build-up of Yttrium and Zirconium were noted. Clearly a much less frequent chemical processing for separation of Y and Zr from Sr would suffice. Only 1.06 neutrons are required for each transmutation of the first 96% of the $Sr^{90}$. The effective half life of $Sr^{90}$ in a flux of $10^{16}$ neutrons per square cm per second is $2\frac{1}{4}$ years.

$Zr^{93}$

Figure 10A:
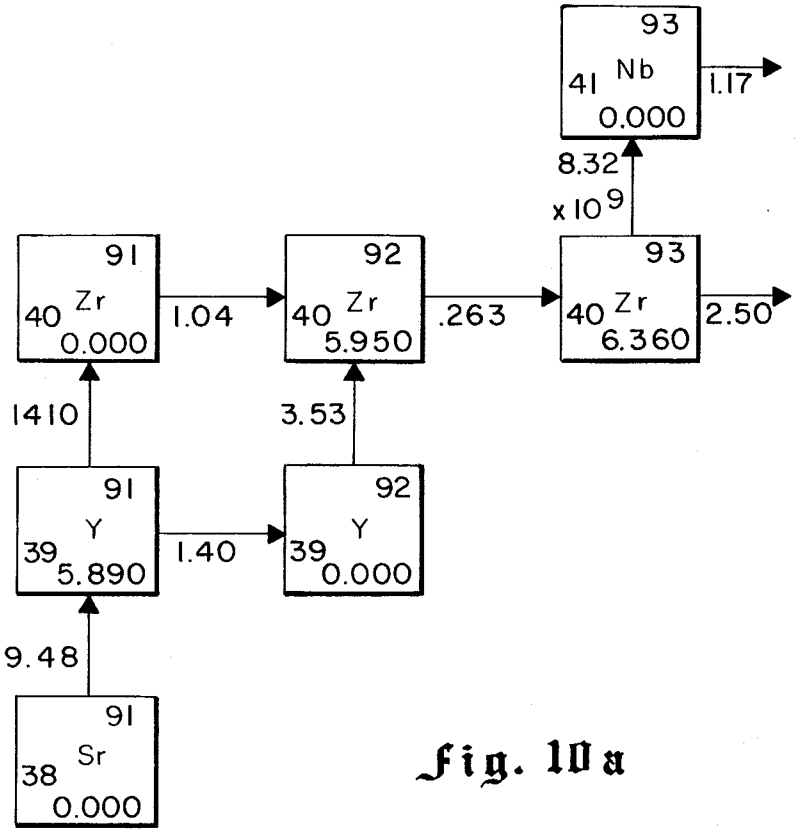
FIG. 10 represents the decay/transmutation chain for $Zr^{93}$.
Figure 10B:
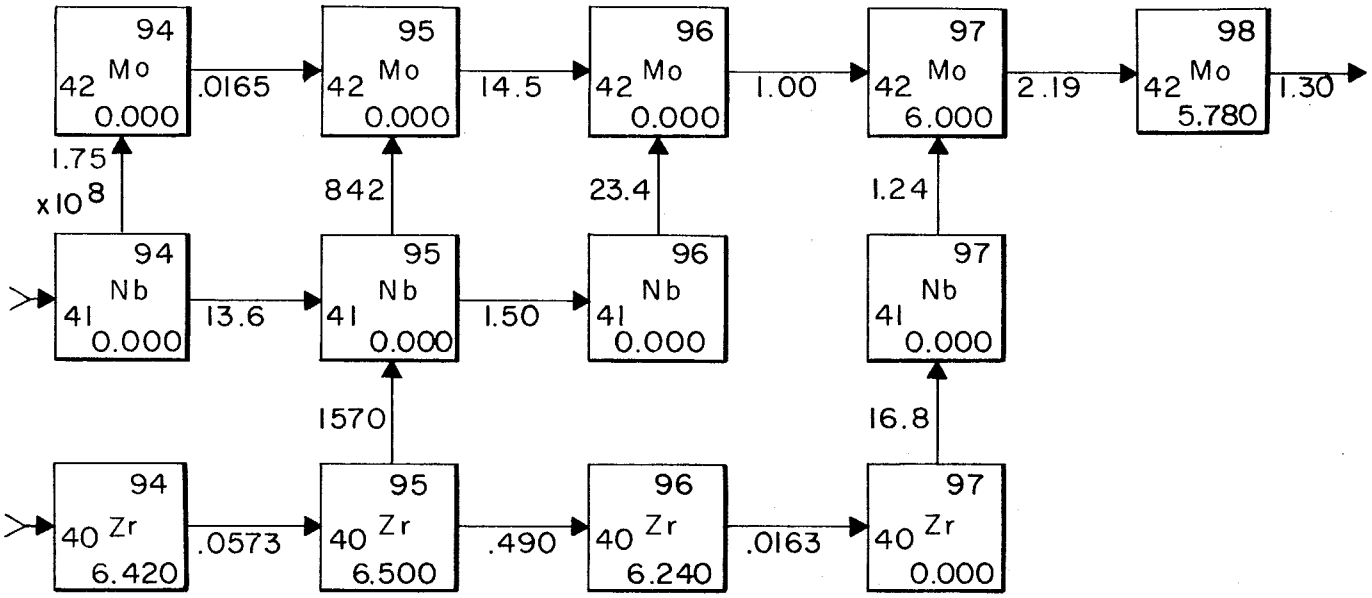

More of the nuclear waste is Zirconium (15%) than any other single element. The presence of many stable isotopes of Zirconium, in addition to the bad isotope $Zr^{93}$, make the removal of this isotope by transmutation difficult. The stable isotopes in the waste are $Zr^{91}$, $Zr^{92}$, $Zr^{94}$, and $Zr^{96}$. Although $Zr^{93}$ has a larger neutron absorption cross section than any of the stable isotopes, it is not larger enough to make transmutation easy. FIG. 10 shows a portion of the decay/transmutation chain including $Zr^{93}$.

Two possibilities for the treatment of $Zr^{93}$ are considered. In the more favorable case, the initial chemical separation is carried out in a time short compared to two months after the fission process. Such is the case, for example, in a liquid fuel reactor with continuous processing for wastes. In this case, the Yttrium is separated from the Zirconium. The $Y^{91}$, with a half life of about two months, decays into stable $Zr^{91}$, which therefore is isolated from the $Zr^{93}$. The $Zr^{92}$, $Zr^{93}$, $Zr^{94}$, $Zr^{95}$, and $Zr^{96}$ are then allowed to stand, allowing the $Zr^{95}$ to decay (with a half life also of about two months).

Figure 11:
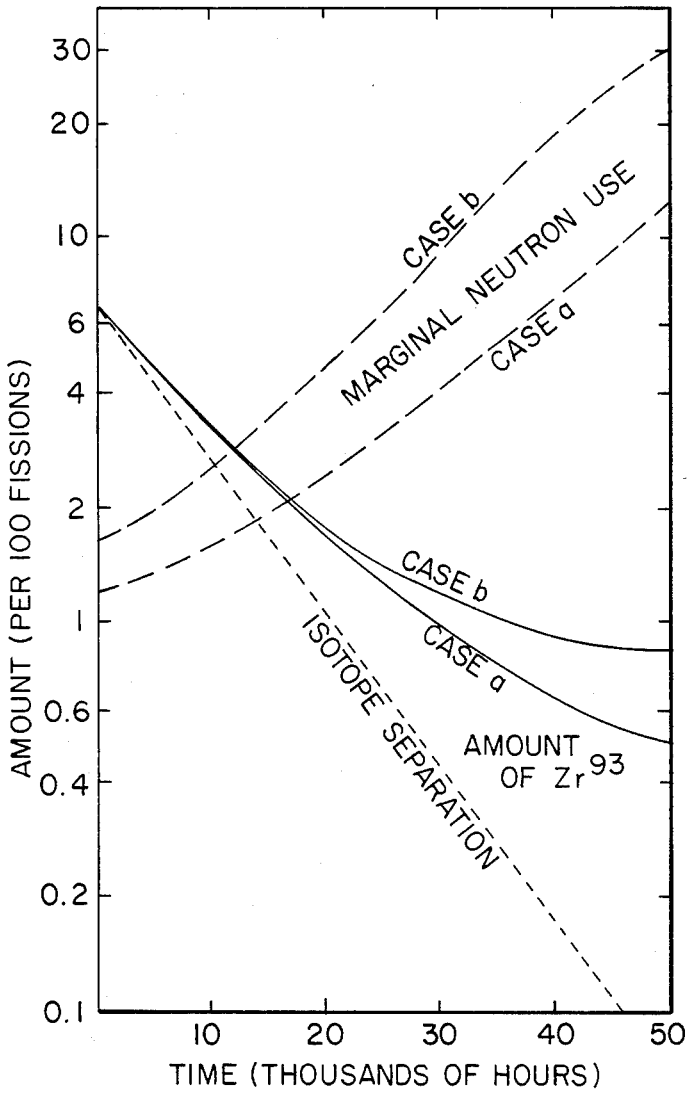
FIG. 11 is a chart showing the removal of $Zr^{93}$ for both chemical and isotope separation.

The results presented for $Zr^{93}$ labelled as case a assume the ideal situation of no $Zr^{91}$ in the Zirconium to be irradiated by the neutrons. In this case, the $Zr^{93}$ which starts at the level of 6.36 atoms per hundred fissions, is irradiated for about 6 years resulting in about 92% net removal of the $Zr^{93}$, at a cost of 12 neutrons, or a little worse than 2 neutrons per atom removed. Further irradiation accomplishes little, because at this point the transmutation of $Zr^{93}$ is approaching equilibrium with the transmutation of $Zr^{92}$ into $Zr^{93}$, and there are significant amounts of $Zr^{94}$ and $Zr^{96}$, as well as $Zr^{92}$ competing for the transmutation neutrons. The removal of $Zr^{93}$ is shown in FIG. 11.

In the less favorable case, labelled b in the results, the $Zr^{91}$ is included. After 50,000 hours (about 6 years) the $Zr^{91}$ has added an extra 6% of the original $Zr^{93}$ by the sequential transmutation chain, $Zr^{91} \rightarrow Zr^{92} \rightarrow Zr^{93}$, and had required an extra 7.2 neutrons, for an average of $3\frac{1}{2}$ neutrons per $Zr^{93}$ atom removed. In both cases, neutron economy is enhanced by periodically separating Zr from Nb and Mo.

It is clear that isotope separation would help greatly for $Zr^{93}$. The exponential removal curve for pure $Zr^{93}$ is compared to the curves for chemical separation in FIG. 11. After 50,000 hours almost 99% of the $Zr^{93}$ is transmuted.

Figure 12A:
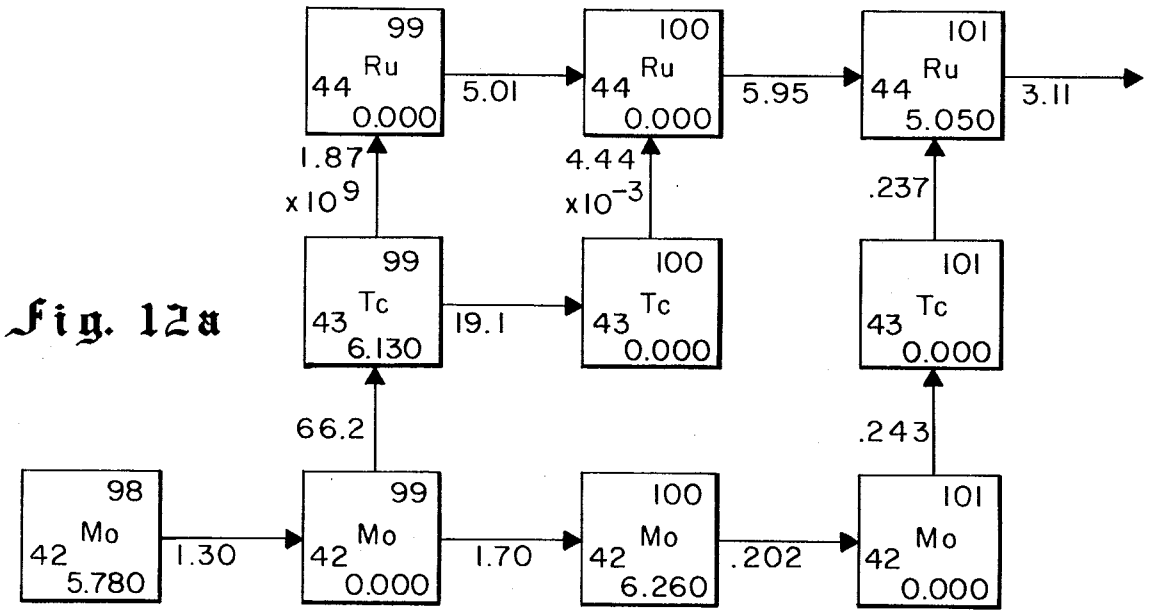
FIG. 12 represents the decay/transmutation chain for $Tc^{99}$.
Figure 12B:
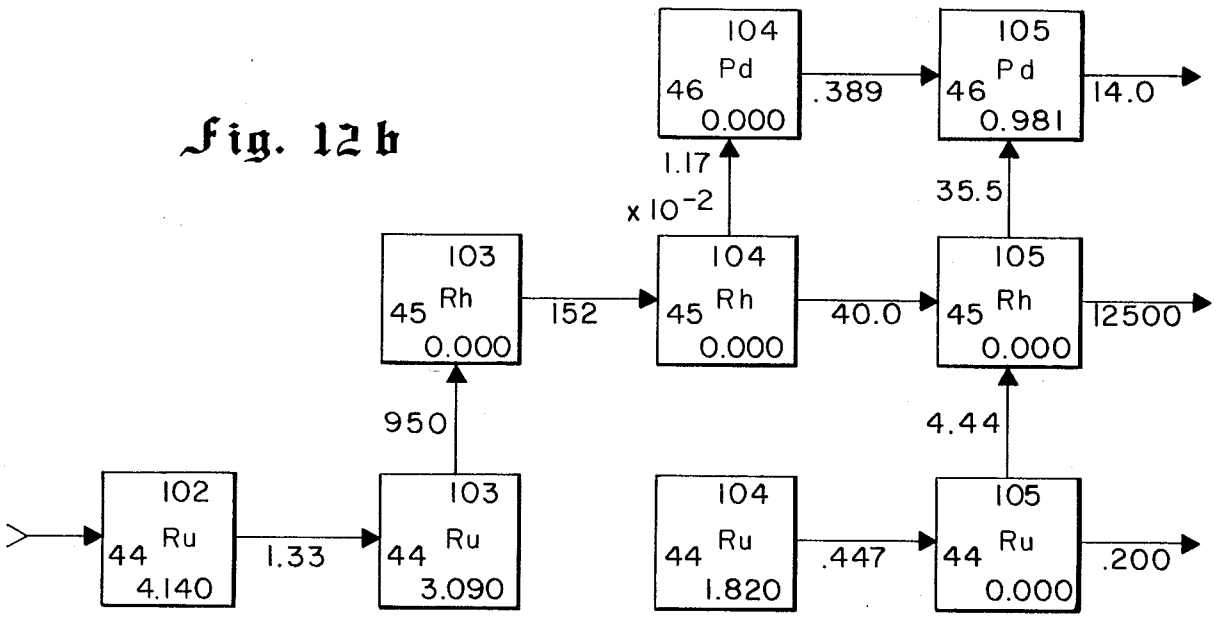

$Tc^{99}$ $Tc^{99}$, whose decay/transmutation chain is shown in FIG. 12, provides one of the most favorable causes for transmutation. It has a reasonably large cross section for neutron absorption and there is only the single isotope, $Tc^{99}$, in the waste. Therefore the removal follows an exponential curve (with an effective half life of 42 days). After chemical processing, all the Tc can be combined, since it is all $Tc^{99}$. With chemical processing every 300 hours, the neutron usage is 1.03 neutrons per transmutation. The extra 3% comes from absorption in $Ru^{100}$ which builds up for the 300 hours.

Figure 13A:
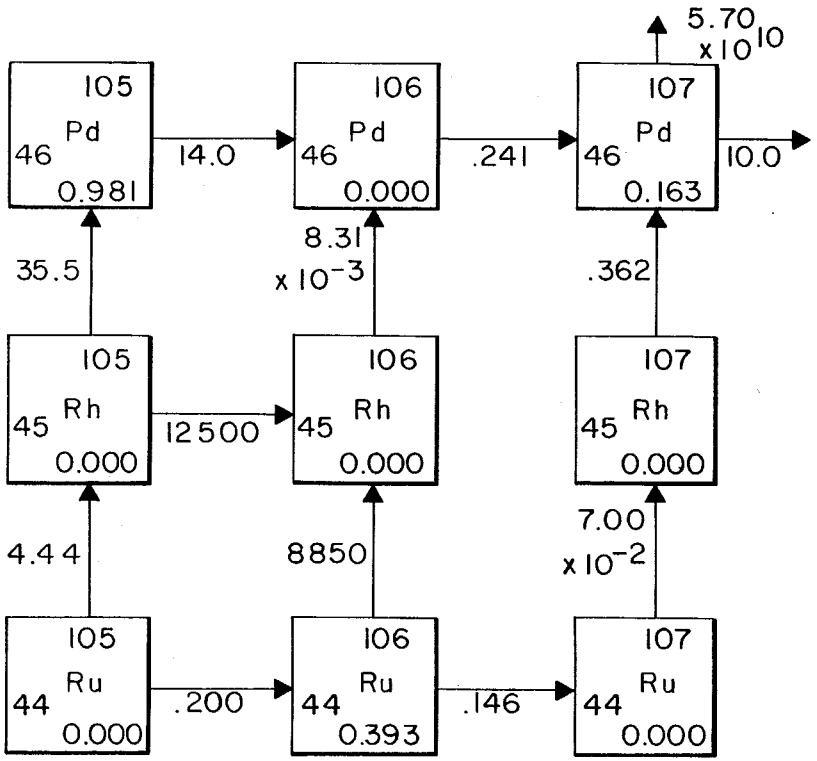
FIG. 13 represents the decay/transmutation chain for $Ru^{106}$ and $Pd^{107}$.
Figure 13B:
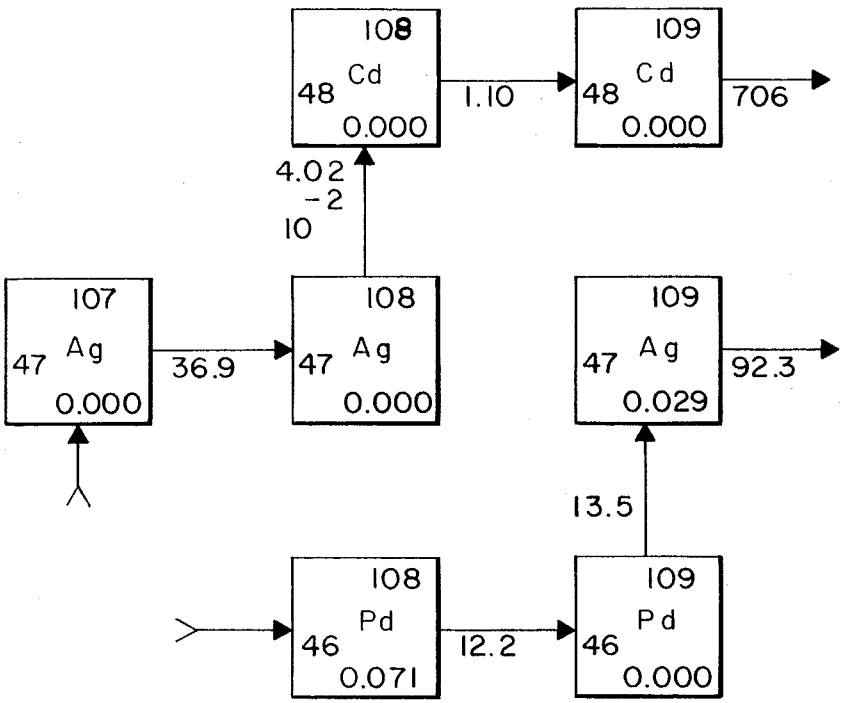
Figure 13C:
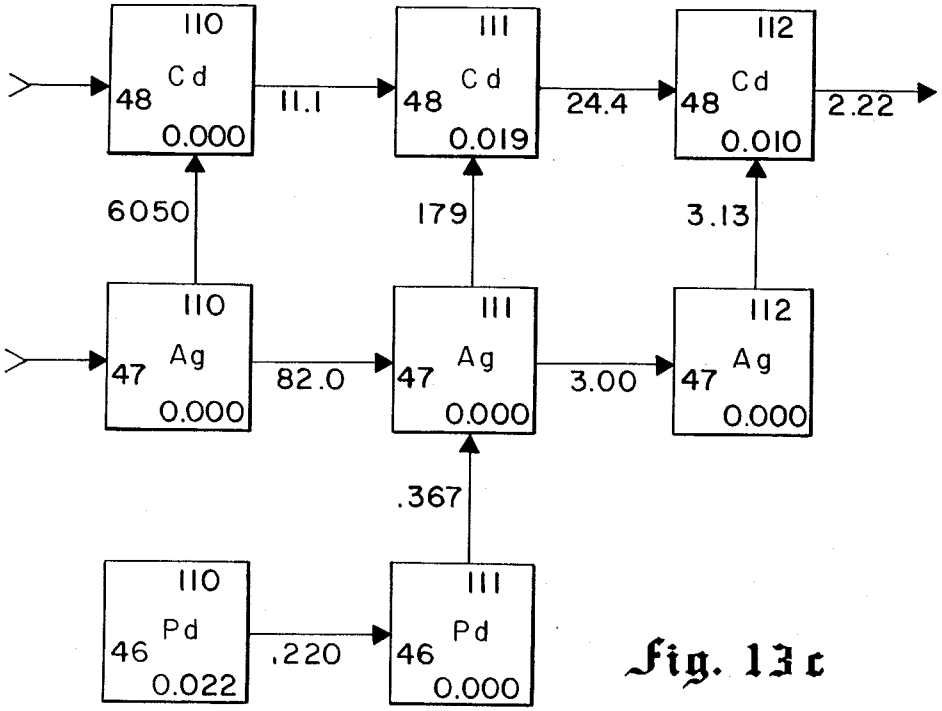

$Ru^{106}$ $Ru^{106}$, whose decay/transmutation chain is shown in FIG. 13, has a half life of 1.01 years, just above the cutoff of 1 year. It requires 33.4 years to decay to half the activity of $U^{238}$. It has a very small neutron absorption cross section, 0.146 barns, requiring an exposure to neutrons for 31.4 years to reduce the activity to the same level. The saving of 2 years is not deemed worth the trouble and expense of cycling and processing. Therefore $Ru^{106}$ may be treated as a short-lived isotope, storing it for at least 33½ years before allowing it to enter the environment.

$Pd^{107}$

The decay/transmutation chain for $Pd^{107}$ is shown in FIG. 13. There is not much $Pd^{107}$ in the waste since it is on the high side of the lighter bump in the fission yield curve. $Pd^{105}$, with an atomic weight smaller by only 2, has 6 times the fission yield. $Ru^{106}$ has an intermediate yield, and decays to $Pd^{106}$ (in two steps) with a half life of 1 year. Ruthenium is assumed to be separated from the Palladium before a significant amount of it has been allowed to decay (if processing occurs within half a year after fission, the results are not substantially modified).

The $Pd^{105}$ has a cross section 40% larger than $Pd^{107}$, which when multiplied by the factor of 6 in yield gives a conversion rate 8.4 times that of $Pd^{107}$. $Pd^{107}$ transmutes to $Pd^{108}$, which, with a roughly comparable cross section, converts to $Pd^{109}$ which rapidly decays. Thus, in the early stages of transmutation it takes over 10 neutrons for each transmutation of a $Pd^{107}$ atom.

Later, the concentration of $Pd^{106}$ builds up, approaching an equilibrium value of about 40 times the amount of $Pd^{107}$, since its cross section is 40 times smaller. At equilibrium 40 atoms of $Pd^{106}$ convert to $Pd^{109}$, requiring 120 neutrons, for every net $Pd^{107}$ removed. The average neutron use per Pd removed approaches $4\times6+2=26$ for each 6 atoms of $Pd^{105}$ and one atom of $Pd^{107}$ converted to $Pd^{109}$.

In an actual example calculation 78% of the $Pd^{107}$ was removed in 9000 hours, at a cost of about 12 neutrons for each atom of $Pd^{107}$ removed. Since the initial amount was small, this corresponds to, for example, a level of $Cs^{135}$ after removal of 99½% of the initial amount.

Neutron economy would dictate removal of Pd from Ag and Cd prior to recycling into each new irradiation step.

$Sn^{126}$ and $Sb^{125}$

Figure 14A:
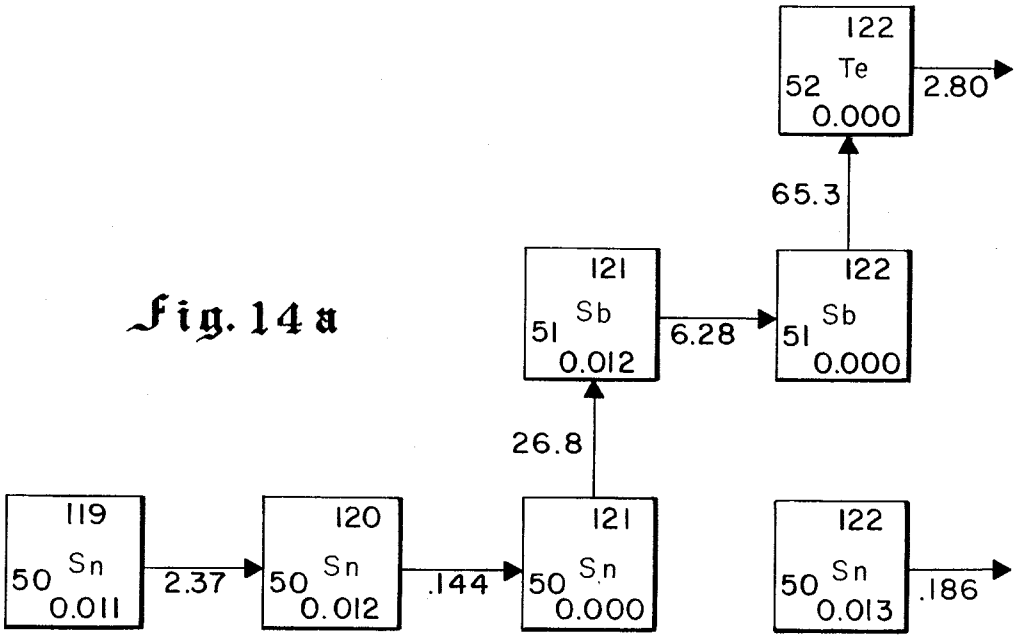
FIG. 14 represents the decay/transmutation chain for $Sn^{126}$ and $Sb^{125}$.
Figure 14B:
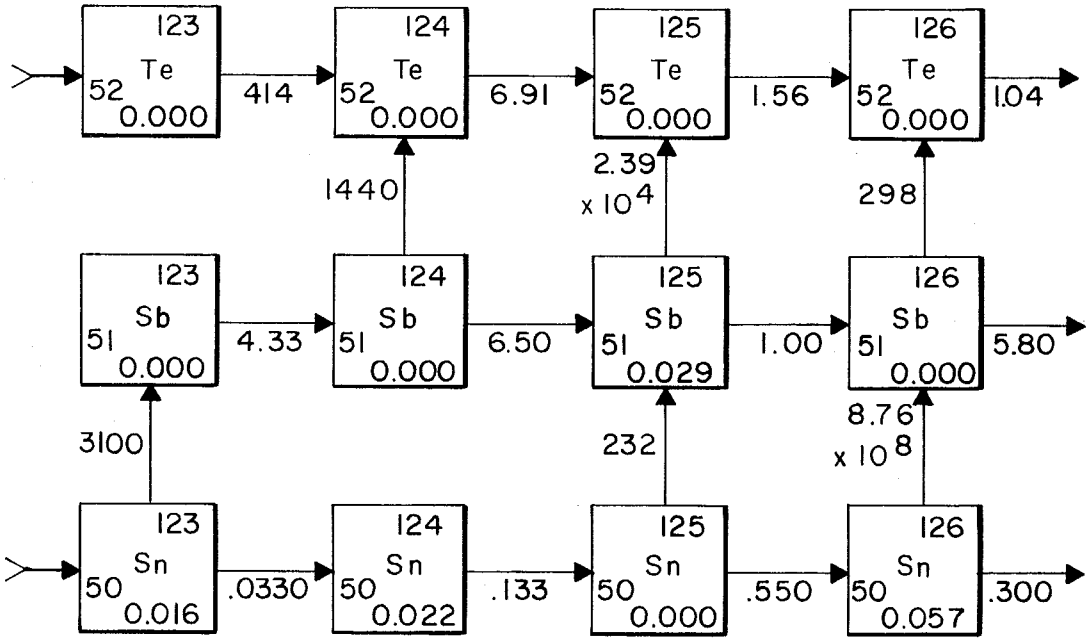
Figure 15A:
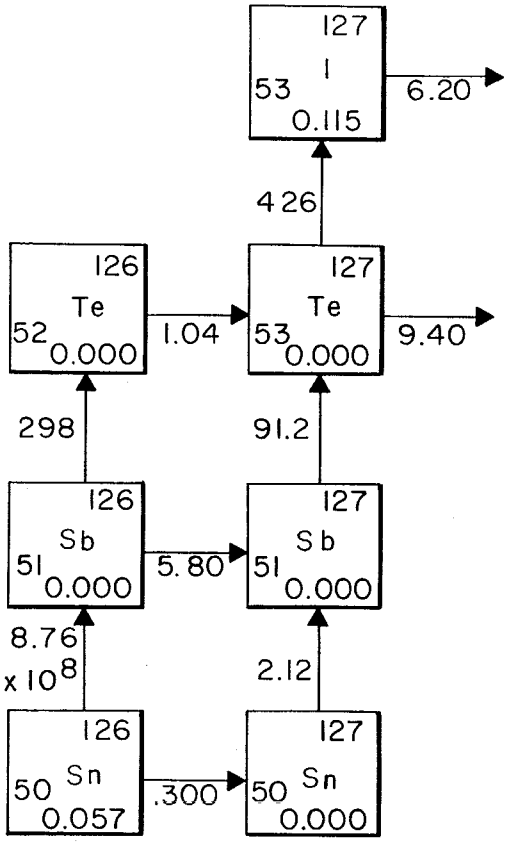
FIG. 15 represents the decay/transmutation chain for $Sn^{126}$ and $I^{129}$.
Figure 15B:
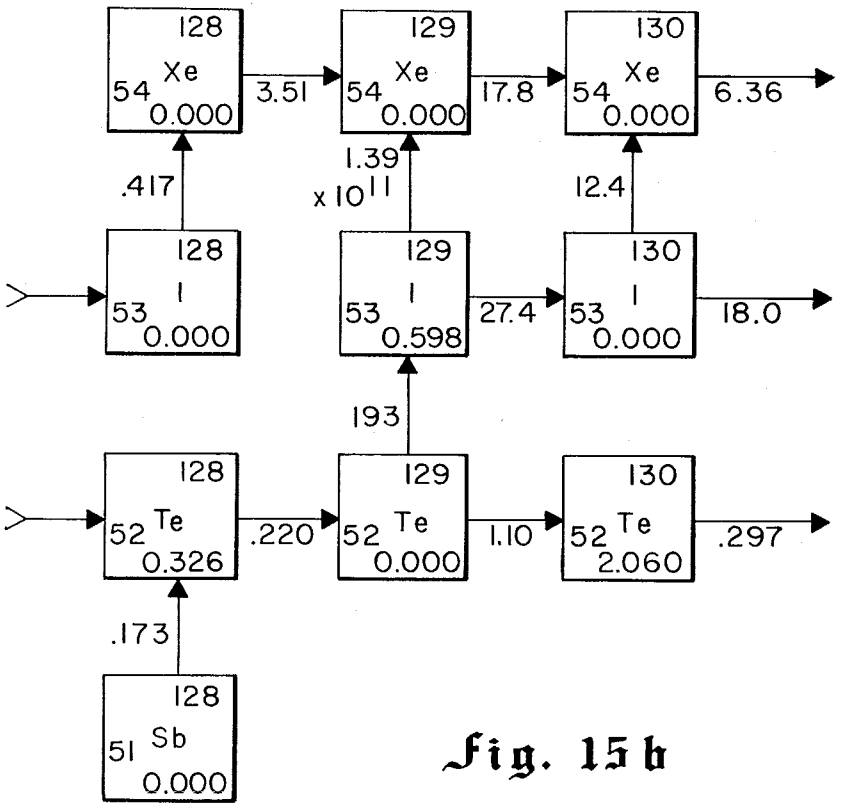
Figure 15C:
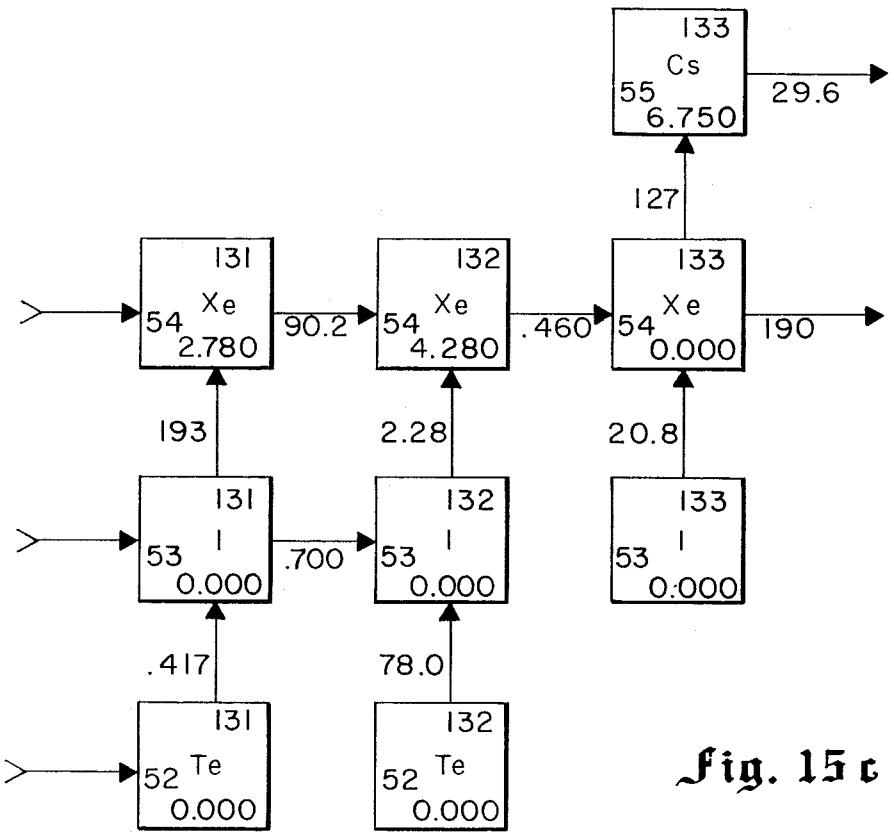

The decay/transmutation chain for $Sn^{126}$ and $Sb^{125}$ are shown in FIG. 14. These isotopes occur at the minimum of the yield curve, and are present in very small amounts. As a result, neutron economy is not of paramount importance and the products I and Te need not generally be separated. They are treated together because exposure of tin to neutrons produces $Sb^{125}$. The cross section for $Sn^{126}$ is very small, so transmutation is very slow. After about 12 years in a flux of $10^{16}$ neutrons/cm$^2$ sec., one third of the original $Sn^{126}$ still remains. However, this corresponds to 0.3% of any one of the five most common bad isotopes. $Sb^{125}$ is easily removed.

$I^{129}$ $I^{129}$ (FIG. 15) is removed following an exponential curve, since $I^{128}$ is highly unstable. The effective half life of $I^{129}$ in a flux of $10^{16}$ neutron/cm$^2$ sec., is about a month. The neutron use does not exceed 1.2 neutrons per $I^{129}$ atom transmuted, as the $I^{129}$ is accompanied by 1/5 as much $I^{127}$. In the early stages, the situation is even more favorable since the cross section for $I^{127}$ is smaller. After 3000 hours, the average use was 1.1 neutrons per transmutation, as only about half of the $I^{127}$ was removed.

The enrichment of $I^{127}$ relative to $I^{129}$ probably is not significant enough, due to the small amount involved, to make it worthwhile keeping the iodine already processed separate from the iodine freshly produced from fission.

The results for a 3000 hour processing run are presented in Table 3, but it is to be understood that exponential removal continues indefinitely.

Iodine may readily be separated from the fission waste and is thus a very favorable element for waste transmutation.

Figure 16A:
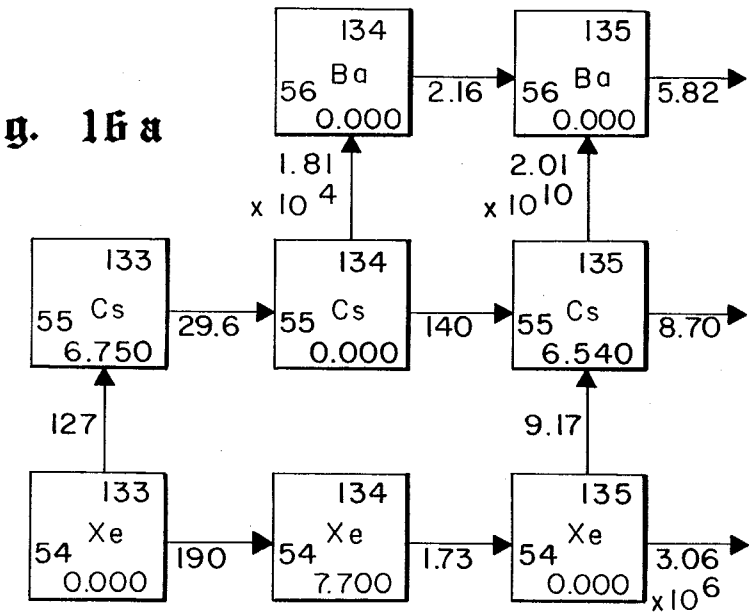
FIG. 16 represents the decay/transmutation chain for the Cesium isotopes.
Figure 16B:
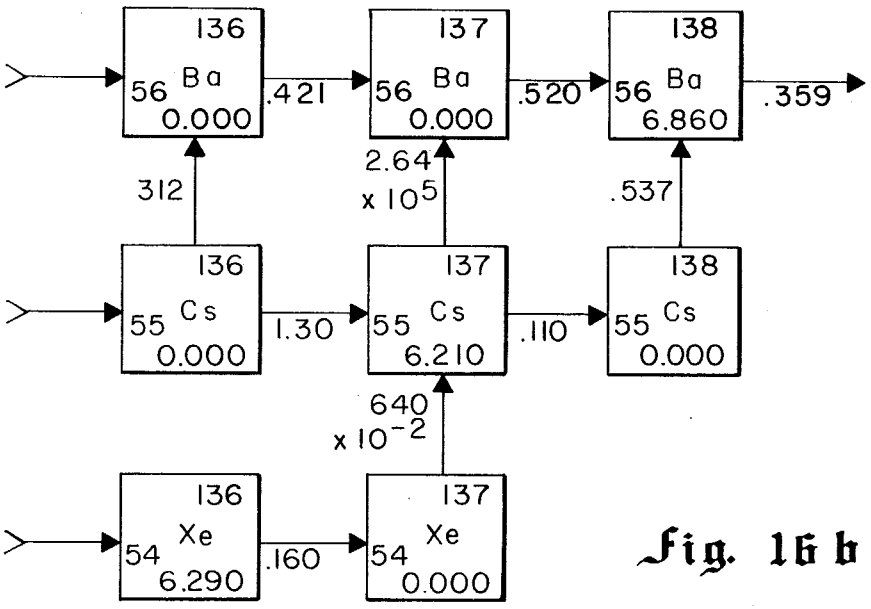

$Cs^{134}$, $Cs^{135}$, and $Cs^{137}$ $Cs^{135}$ and $Cs^{137}$ are somewhat separate problems, and are discussed separately. $Cs^{134}$ is not a direct fission product and therefore occurs in small amounts in the waste. It has a large cross section and is easily removed in the treatment of $Cs^{135}$ and $Cs^{137}$. FIG. 16 shows a portion of the decay/transmutation chain including Cesium.

The major problem with the treatment of $Cs^{135}$ is the large amount (6.75 atoms/100 fissions) of stable $Cs^{133}$ in the waste. $Cs^{133}$ has a considerably higher neutron absorption section than $Cs^{135}$, and must absorb 3 neutrons before again becoming a stable nuclide. The chain is $Cs^{133}{}_n \rightarrow Cs^{134}{}_n \rightarrow Cs^{135}{}_n \rightarrow Cs^{136} \rightarrow Ba^{136}$.

It is noted, however, that the cesium in the waste comes from $\beta$ decay of the inert gas Xenon. $Xe^{133}$ has a half life of over 5 days, and $Xe^{135}$ has a half life of over 9 hours. $Xe^{135}$ has an extremely high neutron absorption cross section ($3\times10^6$ barns) and stable $Xe^{136}$ has a very small cross section (0.16 barns). Stable $Xe^{134}$ also has a rather small cross section (1.73 barns).

If the Xenon is separated in a time small compared to 5 days after fission, and especially if it can be separated in a time small compared to 9 hours, Cesium may be efficiently treated. A liquid fuel reactor would clearly be desirable in achieving these short processing times, since the processing may be continuous.

As soon as Xenon is separated out, it is exposed to a high neutron flux for a short time. At $10^{16}$ neutrons/cm$^2$ sec., the optimum time is 11 minutes. In the example of Table 3, 20 minutes was used. After this irradiation the Xenon is removed from the flux and stored for, say, two months for the $Xe^{133}$ to decay (this is about 30 half lives of $Xe^{133}$). After this, the Xenon left is not radioactive. There may be a further separation of the Cesium produced in the first two hours after fission. Thus there are three, possibly four, places in which Cesium is produced. The Cesium produced before separation consists of some or most of the $Cs^{137}$ and a small amount of $Cs^{135}$ and $Cs^{133}$. The amounts depend on the time before separation. The Cesium produced during the irradiation is some or most of the $Cs^{137}$, and a small amount of $Cs^{135}$ and $Cs^{133}$. For the first two hours after fission, $Cs^{137}$ is produced, and it might be desirable to keep it with the Cesium produced in the first two steps. After 2 hours, most of the $Cs^{133}$ is produced. This $Cs^{133}$ would not be subject to further irradiation. The amount of $Cs^{135}$ that is contained in with this $CS^{133}$ is $4.4\times10^{-6}$ atoms per 100 fissions (22 parts per billion of the waste), coming from the equilibrium between $Xe^{134}$ and $Xe^{135}$.

Figure 17:
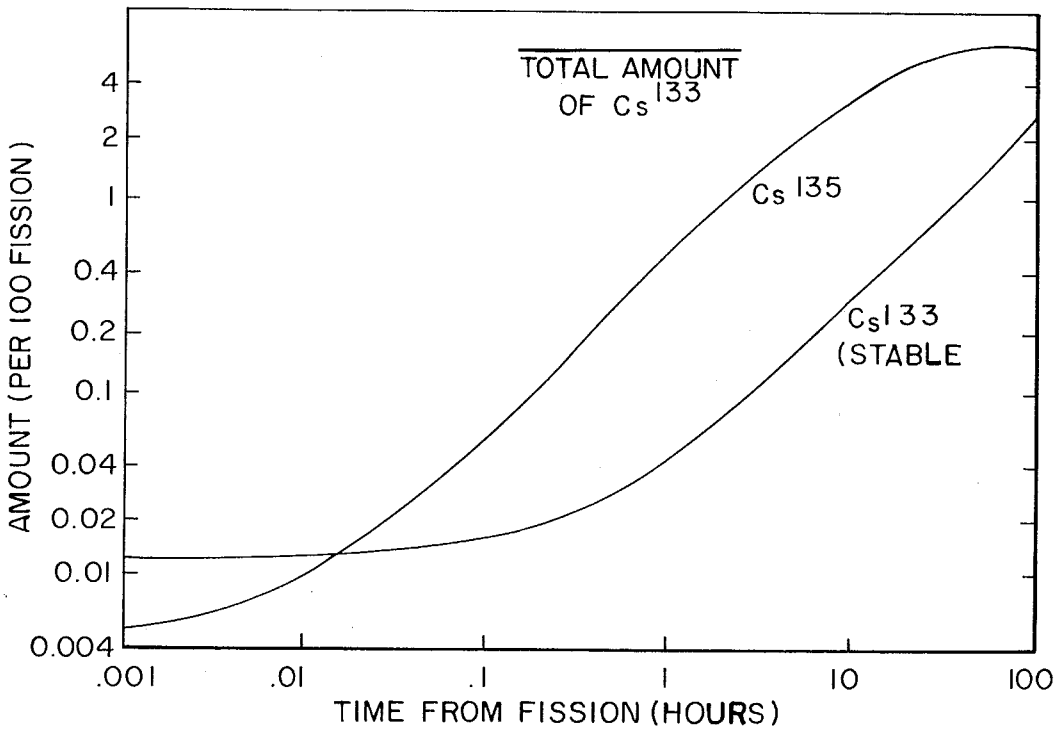
FIG. 17 is a graph showing the amount of $Cs^{135}$ and $Cs^{133}$ as a function of Xenon removal time after fission.

FIG. 17 shows the amount of $Cs^{133}$ and $Cs^{135}$ produced up to end of the time of irradiation as a function of the time of separation. If, for example, separation is accomplished in 6 minutes, there will be 0.055 atoms of $Cs^{135}$ per 100 fissions. In the first two hours after irradiation 0.08 atoms of $Cs^{133}$ per 100 fissions out of a total of 6.75 are produced.

The results labeled a in Table 3 correspond to no further treatment of the $Cs^{135}$, although, of course, it would be treated if the $Cs^{137}$ is treated. The results assume immediate separation of the Xenon.

Figure 18:
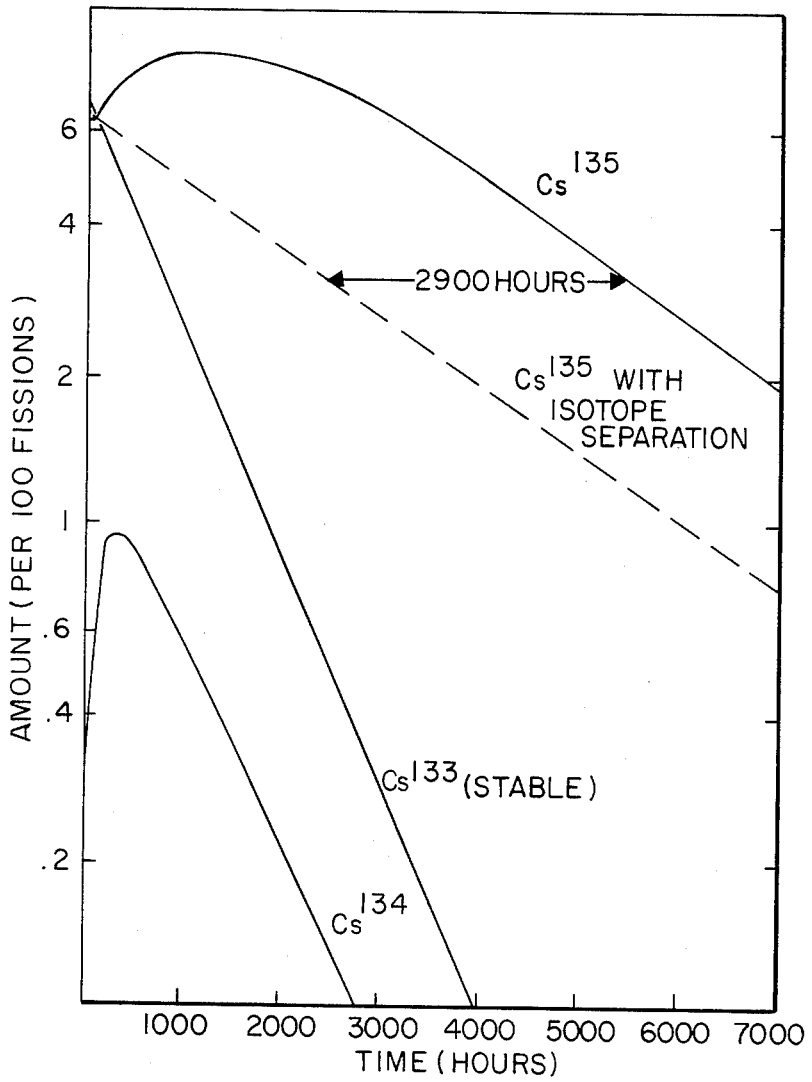
FIG. 18 is a graph showing the amount of $Cs^{133}$, $Cs^{134}$ and $Cs^{135}$ as a function of time.
Figure 19A:
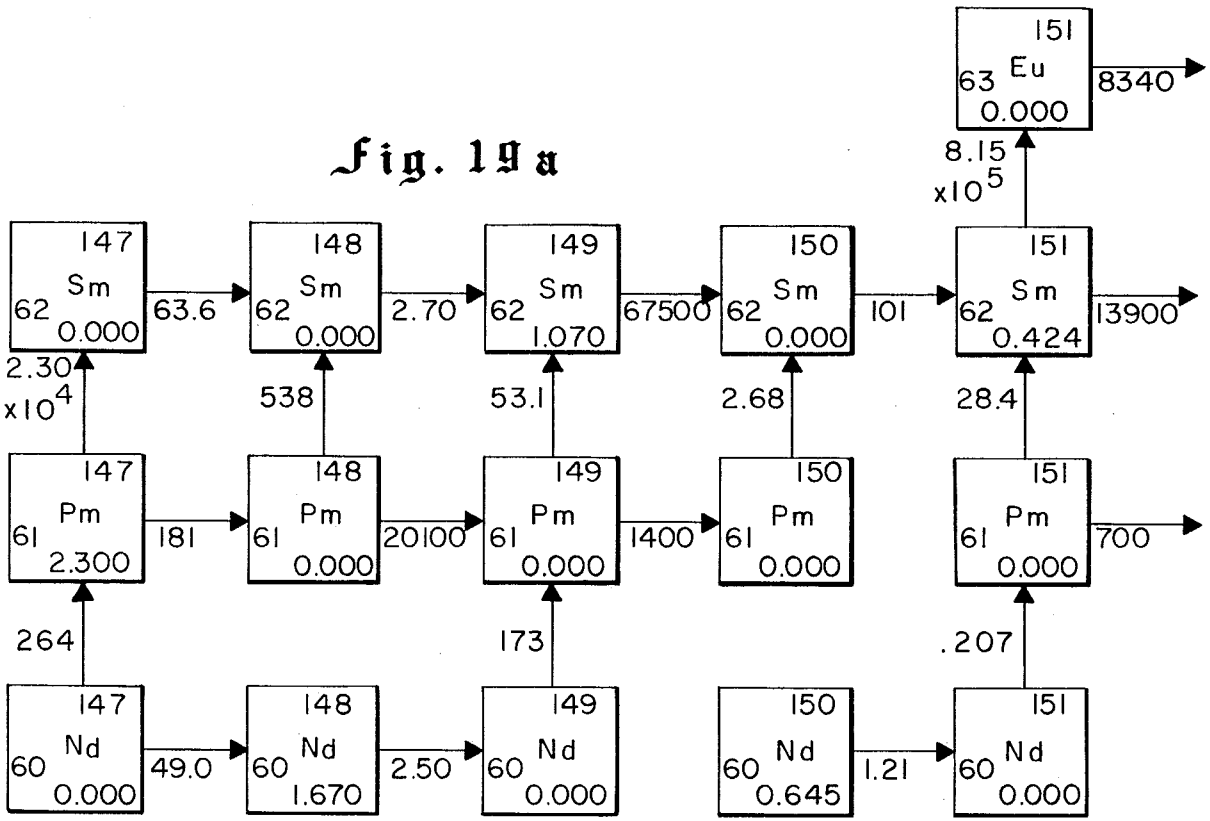
FIG. 19 represents the decay/transmutation chain for $Pm^{147}$ and $Sm^{151}$.
Figure 19B:
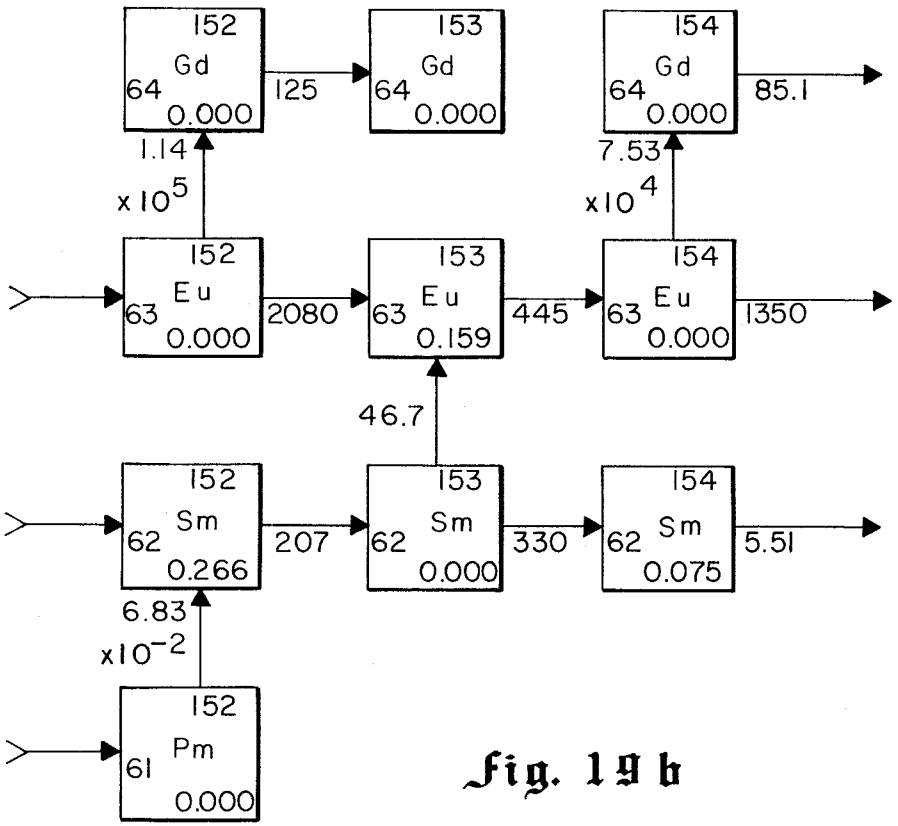

In cases when the Xenon cannot be separated out rapidly (solid fuel reactors), much of the $Xe^{135}$ is not transmuted to $Xe^{136}$, but decays to Cesium which must be treated. These results are shown in FIG. 18, and as case b in Table 3. As can be seen, the time scale is long and the neutron usage is extremely large, costing 20 neutrons (per 100 fissions) to convert the stable $Cs^{133}$ to $Ba^{136}$. Isotope separation would clearly be highly desirable. FIG. 18 shows the following sequence of events:

1. $Cs^{134}$ relatively rapidly builds up from the transmutation of $Cs^{133}$, until after about 500 hours it is in equilibrium with $Cs^{133}$;
2. After about 100 hours enough $Cs^{134}$ has built up that the amount of $Cs^{135}$ actually increases;
3. After 2000 hours the $Cs^{133}$ (and $Cs^{134}$) is mostly depleted, and the $Cs^{135}$ starts being removed following an exponential curve;
4. At about 2700 hours, the amount of $Cs^{135}$ is back to where it started.
5. The amount of $Cs^{135}$ lags 2900 hours (4 months) behind where it would be had there been no $Cs^{133}$ in the waste to be irradiated.

If the $Cs^{135}$ is handled by transmuting $Xe^{135}$, the remainder of the $Cs^{135}$ can be removed following curves similar to case b, but about 100 times lower. The extra neutron usage will also be about 100 times smaller. If the separation time in case a is 2 to 100 hours, a situation intermediate between case a and case b results.

$Cs^{137}$ has the smallest neutron absorption cross section of any of the bad nuclides (with the possible exception of $Se^{79}$). Irradiation in a flux of $10^{16}$ neutrons/cm$^2$ sec., only brings the effective half life to 12 years, compared to 30 years for natural decay. Aside from a small amount of $Cs^{137}$ generated from $Cs^{135}{}_n \rightarrow Cs^{136}{}_n \rightarrow Cs^{157}$, $Cs^{137}$ removal follows an exponential curve (most $Cs^{136}$ decays to $Ba^{136}$).

Since the Cesium becomes essentially pure $Cs^{137}$ as the processing continues, there is no need to segregate the old and new Cesium if $Cs^{137}$ is to be treated.

The modest gain in removal rate in $Cs^{137}$ might make it not worthwhile to treat it beyond what is needed for $Cs^{135}$ removal, unless a flux even higher than $10^{16}$ neutrons/cm$^2$ sec., is utilized. Neutron economy is improved by separation of Cs from all other products, i.e., Ba, La, Ce, etc.

$Pm^{147}$ $Pm^{147}$ (FIG. 19) is the lightest isotope of Promethium in the waste, and the only one with a large half life. It is transmuted following an exponential curve with an effective half life of $4\frac{1}{3}$ days in a flux of $10^{16}$ neutrons/cm$^2$ sec.

The difficulty in removing $Pm^{147}$ concerns neutron economy. In any flux which gives a transmutation rate larger than the natural decay, most of the $Pm^{147}$ ends up as $Sm^{150}$, mostly by the chain $Pm^{147}{}_n \rightarrow Pm^{148}{}_n \rightarrow Pm^{149} \rightarrow Sm^{149} \rightarrow Sm^{150}$. Thus it costs 3 neutrons per $Pm^{147}$ atom transmuted.

There is also a small amount of the bad isotope $Sm^{151}$ created from the $Sm^{150}$, the amount depending on the frequency of chemical separation of the Samarium from the Promethium (the Samarium is then not exposed to any more neutrons). In the example of Table 3, chemical processing was assumed to occur every 2 hours. The amount of $Sm^{151}$ produced is comparable to the amount of $Sm^{151}$ left after the irradiation of the Samarium waste. It is not feasible, without isotope separation, to transmute this $Sm^{151}$.

Since $Pm^{147}$ with a half life of 2.6 years is rendered essentially harmless by storage of about 85 years, while the $Sm^{151}$ produced requires 1900 years to reduce it to the same low level of activity, it may be better not to attempt to transmute the $Pm^{147}$. However, if higher level are considered acceptable, the decrease of 2.3 atoms of $Pm^{147}$ to 0.005 atoms of $Sm^{151}$ is significant.

$Sm^{151}$

The $Sm^{151}$ (FIG. 19) is accompanied by a larger amount of $Sm^{149}$. $Sm^{151}$ has a large neutron absorption cross section ($1.4 \times 10^4$ barns) but $Sm^{149}$ has an even larger cross section by nearly a factor of five.

Figure 20:
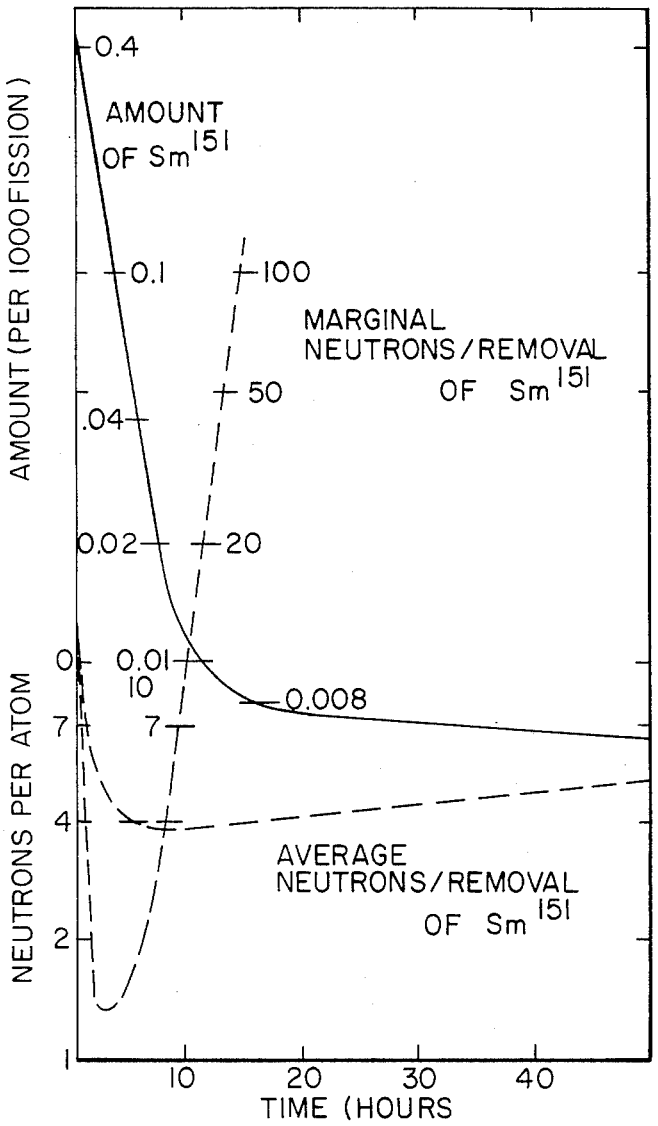
FIG. 20 is a graph showing the removal of $Sm^{151}$ as a function of time.
Figure 21:
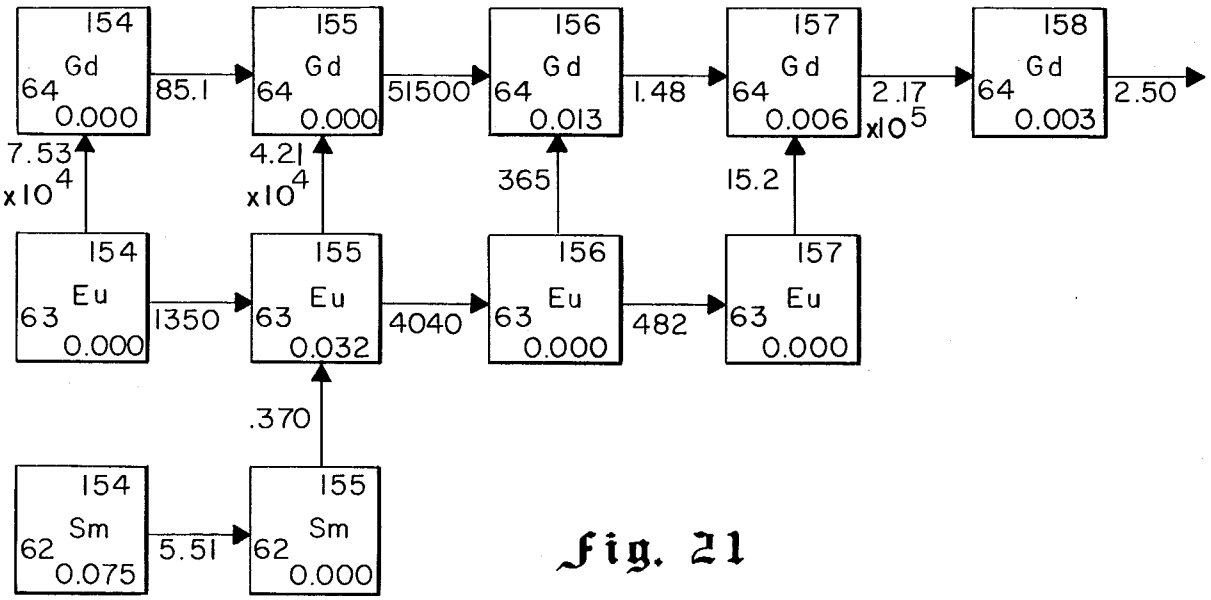
FIG. 21 represents the decay/transmutation chain for $Eu^{154}$ and $Eu^{155}$.

Therefore, as Samarium is exposed to the neutrons, the first thing to happen is the conversion of $Sm^{149}$. This can be seen on FIG. 20 by the large neutron usage in the first two hours of irradiation. The next thing to happen is the transmutation of most of the $Sm^{151}$. The cost in neutrons rises during this period from a minimum at around 3 hours into the irradiation. This rise in neutron usage is due to the competition of neutron absorption in $Sm^{152}$ and $Sm^{150}$, and the $Sm^{151}$ being produced from $Sm^{150}$. Finally, the $Sm^{151}$ comes into equilibrium with the $Sm^{150}$ at a level $Sm^{151}/Sm^{150} = \sigma^{150}/\sigma^{151} \approx 1/40$. At this point, about 98% of the initial amount of $Sm^{151}$ is removed. Equilibrium is nearly obtained after about 15 hours, as seen in FIG. 20. further irradiation is extremely costly in neutron usage even though there is such a small amount of $Sm^{151}$ remaining. Moreover, the $Sm^{151}$ resulting from the treatment of Promethium is at roughly the same level. The treatment of this other Samarium would actually cause an increase in the amount of $Sm^{151}$, since the $Sm^{151}/Sm^{150}$ ratio is well below 1/140. Thus, withwout isotope separation, (or an extremely copious supply of neutrons) a reduction of $Sm^{151}$ to about 0.013 atom per 100 fissions is the best that can be achieved. Neutron economy may be enhanced primarily by separation of Eu products.

$Eu^{152}$, $Eu^{154}$, $Eu^{155}$

Europium (FIGS. 19 & 21) is one of the heaviest elements in the waste, and occures in small amounts. $Eu^{152}$ and $Eu^{154}$ do not occur directly as fission products. What little $Eu^{152}$ does occur will be rapidly transmuted while the $Eu^{155}$ is being removed, as will the $Eu^{151}$ coming from that $Sm^{151}$ that decayed before it was transmuted.

In processing the Europium, it need not be separated from the Samarium while the Samarium is being processed, as there will be small amounts of radioactive Europium produced in the treatment of $Sm^{151}$, which should be included with the fission-produced $Eu^{155}$.

Transmutation of $Eu^{155}$ per se is very simple, as indicated by the "isotope separation" columns of Table 3. However, the waste contains some $Eu^{153}$, which is converted to radioactive $Eu^{154}$. Therefore, in order to remove the $Eu^{155}$ it is necessary to convert the $Eu^{153}$ by the chain $Eu^{153}{}_n \rightarrow Eu^{154}{}_n \rightarrow Eu^{155}{}_n \rightarrow Eu^{156}{}_n \rightarrow Eu^{157} \rightarrow Gd^{157}{}_n \rightarrow Gd^{158}$. There is 5 times as much $Eu^{153}$ as $Eu^{155}$, and it requires 5 neutrons for conversion to $Gd^{158}$ leading to $26\frac{1}{2}$ neutrons per atom of $Eu^{155}$ removed.

If the flux were 10–30 times smaller, the $Eu^{156}$ would have time to decay, terminating the chain at Gd, saving up to 40% of the neutrons.

Figure 22:
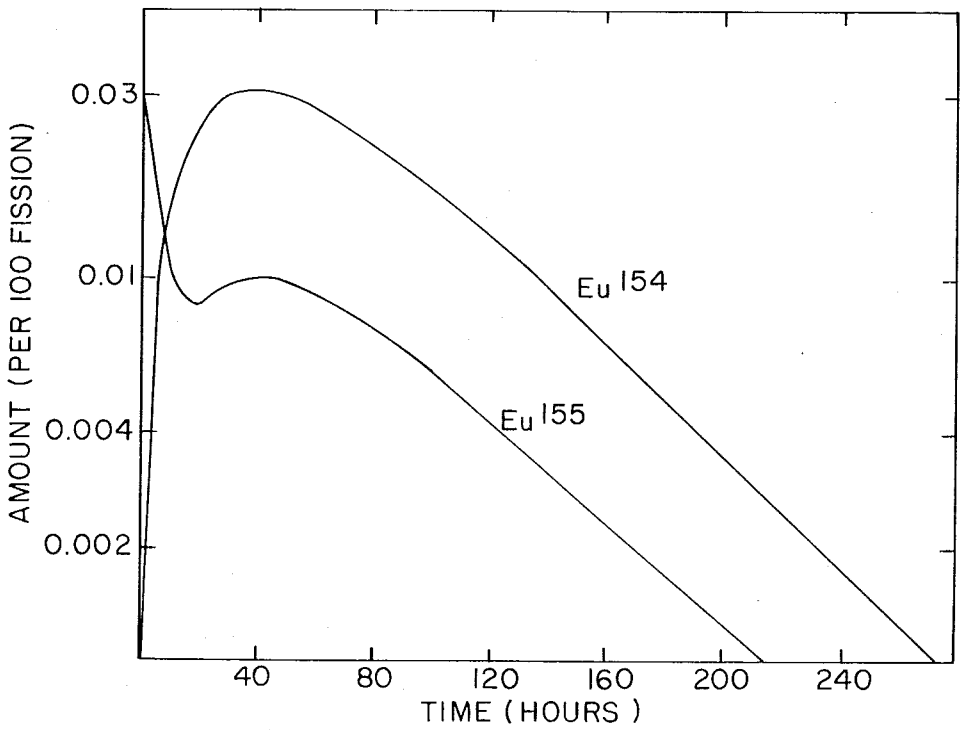
FIG. 22 is a graph showing the time development of $Eu^{154}$ and $Eu^{155}$.

FIG. 22 shows the time development of the amounts of $Eu^{154}$ and $Eu^{155}$. For the first 15 hours or so, the initial $Eu^{155}$ is rapidly transmuted away, while the $Eu^{154}$ builds up almost as fast as the $Eu^{155}$ is removed. After that, the $Eu^{154}$ continues to build up while it, in turn, transmutes to $Eu^{155}$. After about 60 hours the $Eu^{154}$ and $Eu^{155}$ are in equilibrium with the remaining $Eu^{153}$, and then are removed at a rate determined by the $Eu^{153}$ cross section.

In the processing, all isotopes of Europium are removed. Therefore no harm is caused by combining the already-processed Europium with fresh Eu.

ACTINIDES

The amounts and composition of the actinides depends on the parameters of the reactor system such as the enrichment of the Uranium and the integrated flux to which it has been exposed. We consider four components of the actinides produced from $U^{238}$ and $U^{235}$ by neutron absorption, which may coincide with the components in the transmutation system. These components are:

1. $U^{236}$
2. $Np^{237}$
3. Fresh plutonium
4. Spent plutonium and trans-plutonium actinides Fifteen percent of the $U^{235}$ on absorbing a neutron does not fission but produces $U^{236}$. This $U^{236}$ would be only moderately expensive in neutrons to transmute except that it is mixed in with all the $U^{238}$ in the spent fuel. It is impossible from the point of view of neutron economy to put the $U^{238}$ in the high flux region. If the $U^{236}$ produced from all $U^{235}$ by neutron irradiation is mixed in with the amount of $U^{238}$ accompanying that much $U^{235}$ in natural uranium, the radioactivity is double that of $U^{238}$. Therefore, $U^{236}$ does not pose a serious hazard if combined with the $U^{238}$.

Some of the $U^{236}$ will absorb a neutron, giving the transmutation chain $$U^{236}{}_{n} \rightarrow U^{237} \rightarrow Np^{237}.$$

If this $Np^{237}$ is exposed to as high a flux as possible, it first transmutes to $Np^{238}$ which then fissions if it absorbs a neutron or decays to $Pu^{238}$. The fissioning is preferable on the grounds of neutron economy.

$U^{238}$, if it absorbs a neutron, becomes $Pu^{239}$. This plutonium (as well as the $Pu^{238}$ discussed above) is, on separation, used as a fissionable substance. In thermal fission, $\frac{3}{4}$ is fissioned and $\frac{1}{4}$ becomes $Pu^{240}$. The $Pu^{240}$ absorbs a neutron becoming $Pu^{241}$. Three-fourths of $Pu^{241}$ fissions and $\frac{1}{4}$ becomes $Pu^{242}$.

$Pu^{242}$ and heavier isotopes are not fissionable with high probability and form part of the heavy actinide waste. By sequential neutron absorption, these eventually lead to fission. Fissionable isotopes include $Cm^{245}$, $Cm^{247}$, $Bk^{250}$, $Cf^{249}$, $Cf^{251}$, and $Es^{254}$. Although the number of neutrons required per atom of $Pu^{242}$ is large, the very small quantities involved makes the neutron usage not have a serious effect on the total neutron economy. This is consistent with the conclusion of earlier studies that actinides can be reduced by transmutation.

The neutron economy is approximately a net loss of one neutron for each atom of $Np^{237}$ (including the absorption on $U^{236}$) and approximately a balance (a small net loss) for each atom of $U^{238}$ transmuted. In addition, the fission wastes from Plutonium and other actinides increase the amount of fission wastes that must be processed by the excess neutrons from the fission of $U^{235}$.

TABLE 1

THE TWO GROUPS OF BAD FISSION PRODUCT NUCLIDES CONSIDERED, THEIR HALF LIFE, NEUTRON ABSORPTION CROSS SECTION, AND FISSION YIELD
BAD NUCLIDES

| Isotope | Half Life (Years) | Cross Section (Barns) | Amount (per 100 Fissions) | Element Name |
|---|---|---|---|---|
| $Ru^{106}$ | 1.01 | .146 | .393 | Ruthenium |
| $Cs^{134}$ | 2.06 | 140 | 0 | Cesium |
| $Pm^{147}$ | 2.62 | 181 | 2.30 | Promethium |
| $Sb^{125}$ | 2.73 | 1.00 | .029 | Antimony |
| $Eu^{155}$ | 4.80 | 4040 | .032 | Europium |
| $Eu^{154}$ | 8.59 | 1350 | 0 | Europium |
| $Kr^{85}$ | 10.7 | 1.66 | .287 | Krypton |
| $Eu^{152}$ | 13.0 | 2080 | 0 | Europium |
| $Sr^{90}$ | 28.1 | .900 | 5.84 | Strontium |
| $Cs^{137}$ | 30.1 | .11 | 6.21 | Cesium |
| $Sm^{151}$ | 92.9 | 13900 | .424 | Samarium |
| $Se^{79}$ | $6.50 \times 10^4$ | — | .055 | Selenium |
| $Sn^{126}$ | $9.99 \times 10^4$ | .300 | .057 | Tin |
| $Tc^{99}$ | $2.13 \times 10^5$ | 19.1 | 6.13 | Technetium |
| $Zr^{93}$ | $9.49 \times 10^5$ | 2.50 | 6.36 | Zirconium |
| $Cs^{135}$ | $2.30 \times 10^6$ | 8.70 | 6.54 | Cesium |
| $Pd^{107}$ | $6.50 \times 10^6$ | 10.0 | .163 | Palladium |
| $I^{129}$ | $1.59 \times 10^7$ | 27.4 | .598 | Iodine |

TABLE 2

A COMPARISON OF THE NATURAL HALF LIFE WITH THE EFFECTIVE HALF LIFE AT A FLUX OF $10^{16}$ NEUTRONS/CM$^2$ SEC FOR THE TWO GROUPS OF BAD NUCLIDES

| Nuclide | Natural Half Life (Y) | Half Life at Flux $10^{16}$ Neut./cm$^2$ sec |
|---|---|---|
| $Ru^{106}$ | 1.01 | .95 |
| $Cs^{134}$ | 2.06 | .016 |
| $Pm^{147}$ | 2.62 | .012 |
| $Sb^{125}$ | 2.73 | 1.2 |
| $Eu^{155}$ | 4.80 | $5.5 \times 10^{-4}$ |
| $Eu^{154}$ | 8.59 | .0016 |
| $Kr^{85}$ | 10.7 | 1.2 |
| $Eu^{152}$ | 13.0 | .0011 |
| $Sr^{90}$ | 28.1 | 2.25 |
| $Cs^{137}$ | 30.1 | 12.00 |
| $Sm^{151}$ | 92.9 | $1.6 \times 10^{-4}$ |
| $Se^{79}$ | $6.50 \times 10^4$ | ? |
| $Sn^{126}$ | $9.99 \times 10^4$ | 7.32 |
| $Tc^{99}$ | $2.13 \times 10^5$ | .115 |
| $Zr^{93}$ | $9.49 \times 10^5$ | .88 |
| $Cs^{135}$ | $2.3 \times 10^6$ | .25 |
| $Pd^{107}$ | $6.5 \times 10^6$ | .22 |
| $I^{129}$ | $1.59 \times 10^7$ | .08 |

TABLE 3

SUMMARY OF OUR RESULTS
THE INITIAL AND FINAL AMOUNTS, THE NEUTRONS USED AND THE TIME IRRADIATED AT $10^{16}$ NEUTRONS/CM$^2$ SEC FOR BOTH CHEMICAL AND ISOTOPE SEPARATION. AMOUNTS ARE NORMALIZED TO 100 FISSIONS. CASES a AND b FOR CESIUM AND ZIRCONIUM ARE EXPLAINED IN SEC VII. SUBTOTALS FOR EACH GROUP ARE SHOWN, AS WELL AS THE TOTALS.

| | | | WITH CHEMICAL SEPARATION | | | WITH ISOTOPE SEPARATION | | |
|---|---|---|---|---|---|---|---|---|
| Nuclide | Initial Amount | | Final Amount of Nuclide | Neutrons Used | Time (hr) | Final Amount of Nuclide | Neutrons Used | Time (hr) |
| (HALF LIFE LESS THAN 100 YEARS) | | | | | | | | |
| $Ru^{106}$ | .393 | | .393 | 0 | — | .393 | 0 | — |
| $Cs^{134}$ | 0 | a: | 0 | 0 | $<\frac{1}{3}$ | — | — | — |
| | | b: | ~0 | 0 | 20,000 | — | — | — |
| $Pm^{147}$ | 2.30 | | .147 | 6.31 | 420 | .147 | 2.15 | 420 |
| $Sb^{125}$ | .029 | | .0014 | .05 | 102,000 | .000038 | .03 | 102,000 |
| $Eu^{155}$ | .032 | | $10^{-6}$ | .85 | 600 | $10^{-6}$ | .03 | 70 |
| $Eu^{154}$ | 0 | | $3 \times 10^{-6}$ | — | 600 | — | — | — |
| $Kr^{85}$ | .287 | | .0714 | 1.31 | 48,000 | .011 | .28 | 48,000 |
| $Eu^{152}$ | 0 | | 0 | 0 | — | — | — | — |
| $Sr^{90}$ | 5.84 | | .254 | 6.17 | 90,000 | .245 | 5.59 | 90,000 |
| $Cs^{137}$ | 6.21 | a: | 3.21 | 3.00 | 100,000 | 3.21 | 3.00 | 100,000 |
| | | b: | 3.34 | 3.00 | 100,000 | — | — | — |
| $Sm^{151}$ | .424 | | .013 | 1.69 | 16 | .00023 | .42 | 15 |
| SUBTOTAL | 15.5 | a: | 4.09 | 19.4 | | 4.01 | 11.5 | |
| | | b: | 4.22 | 19.4 | | | | |
| (HALF LIFE GREATER THAN 30,000 YEARS) | | | | | | | | |
| $Se^{79}$ | .055 | | .055 | 0 | — | .055 | 0 | — |
| $Sn^{126}$ | .057 | | .019 | .11 | 102,000 | .019 | .04 | 102,000 |
| $Tc^{99}$ | 6.13 | | .013 | 6.30 | 9,000 | .013 | 6.13 | 9,000 |
| $Zr^{93}$ | 6.36 | a: | .50 | 12.0 | 50,000 | .071 | 6.29 | 50,000 |
| | | b: | .86 | 19.2 | 50,000 | — | — | — |
| $Cs^{135}$ | 6.54 | a: | .0045 | 6.55 | $<\frac{1}{3}$ | — | — | — |
| | | b: | .0317 | 26.7 | 20,000 | .0124 | 6.53 | 20,000 |
| $Pd^{107}$ | .163 | | .0351 | 1.64 | 9,000 | .0064 | .16 | 9,000 |
| $I^{129}$ | .598 | | .031 | .63 | 3,000 | .031 | .57 | 3,000 |
| SUBTOTAL | 19.9 | a: | .66 | 27.2 | | .21 | 19.7 | |
| | | b: | 1.04 | 54.6 | | | | |
| TOTAL | 35.4 | a: | 4.75 | 46.6 | | 4.22 | 31.2 | |
| | | b: | 5.26 | 74.0 | | | | |

TABLE 4

ELEMENTS WITH SIGNIFICANT AMOUNTS OF STABLE ISOTOPES REMAINING AFTER PROCESSING. SHOWN ARE THE NUMBER OF NEUTRONS (NORMALIZED TO 100 FISSIONS) NEEDED TO TRANSMUTE ALL THE STABLE ISOTOPES TO OTHER ELEMENTS.

| Element | Bad Isotope Left | Neutrons required to transmute stable isotopes |
|---|---|---|
| Kr | .07 | 6.0 |
| Sr | .25 | 3.2 |
| Zr | .50 | 23.6 (1) |
| Pd | .035 | 1.3 |
| Sm | .013 | 14.8 (2) |

(1) Zr: case a (no $Zr^{91}$ in initial waste.)
(2) Includes Sm transmutation of Pm.

CONTROL PROGRAM FOR WASTE

```
CONTROL PROGRAM FOR WASTE
1       PRINT 1000
1000    FORMAT(//'CHOOSE ONE OF THE FOLLOWING OPTIONS:'//
       2'1.     INPUT DATA'/
       3'2.     INPUT CHAINS OF DECAY/TRANSMUTATION'/
       4'3.     INPUT AMOUNTS OR CHEMICAL PROCESSING'/
       5'4.     CALCULATE TRANSITION COEFFICIENTS'/
       6'5.     CALCULATE AMOUNTS AS A FUNCTION OF TIME'/
       7'6.     OUTPUT DATA TABLE'/
       8'7.     EXIT')
        READ (1,*,ERR=1) N
        GOTO (11,12,13,14,15,16,17),N
        GOTO 1
11      CALL INDATA
        GOTO 1
12      CALL INCHA
        GOTO 1
13      CALL INCASE
        GOTO 1
14      CALL WASTE
        GOTO 1
15      CALL MAIN
        GOTO 1
16      CALL NUCL
        GOTO 1
17      CALL EXIT
        END
        SUBROUTINE WASTE


        SUBROUTINE WASTE
C       WASTE PROGRAM
C
C             COMPUTES TRANSITION COEFFICIENTS
        DIMENSION ACO(80,80),
       1ALAM(50),BSIG(50),BSIGF(50),
       2CHIR(50)
        DIMENSION THALF(250),SIG(250),SIGFS(250)
        DIMENSION QCO(80,80)
        COMMON/AREA1/CHIR
        COMMON /AREA5/NAME
        COMMON /QCO/QCO
        REAL*8 NAME(50),NAMEN(2)
        INTEGER ATNUM(250),ATWT(250),NME(250),NAT(50),A(50)
       2,NI(50)
$INSERT SYSCOM>KEYS.F
$INSERT SYSCOM>ERRD.F
        CALL SRCH$$(K$READ,'DATA',4,1,IT,IC)
        DO 102 NTOT=1,250
        READ (5,100) J,ATNUM(NTOT),NME(NTOT),ATWT(NTOT),
       2  THALF(NTOT),SIG(NTOT),SIGFS(NTOT)
100     FORMAT (2I3,A2,I3,3E11.4)
        IF (J.EQ.0) GOTO 103
102     CONTINUE
103     NTOT=NTOT-1
        CALL SRCH$$(K$CLOS,'DATA',4,1,IT,IC)
305     PRINT 1002
1002    FORMAT (/'INPUT FLUX IN UNITS OF NUMBER/SECOND')
306     READ (1,*,ERR=305)ZZ
        Z=ZZ/1.E24
        PRINT 1010
1010    FORMAT (/'INPUT FILE NAME')
314     READ (1,7002,ERR=313) NAMEN(2)
        LENGTH=8
        CALL SRCH$$(K$WRIT,NAMEN(2),LENGTH,2,IT,IC)
```

```
      WRITE (6,3002)ZZ
3002  FORMAT (2E14.7)
      CALL SRCH$$(K$READ,'CHAINS',6,3,IT,IC)
501   READ (7,1011) NPAR,IWTPAR,MAXN,MAXW
      IF (NPAR.NE.0) GOTO 503
1011  FORMAT (5X,I3,2X,I3,4X,I3,2X,I3)
      CALL SRCH$$(K$CLOS,'CHAINS',6,3,IT,IC)
      IZERO=0
      ZERO=0.
      WRITE (6,3003) IZERO,IZERO,IZERO,ZERO
      CALL SRCH$$(K$CLOS,NAMEN(2),LENGTH,2,IT,IC)
      PRINT 1012 NAMEN(2)
1012  FORMAT (/'TRANSITION COEFF''S HAVE BEEN ENTERED'
     2,' IN FILE "',A8,'"')
600   PRINT 601
601   FORMAT (/'STOP?')
      READ (1,602)X
602   FORMAT (A1)
      IF (X.EQ.'N') GOTO 603
      RETURN
503   N=0
      DO 104 I=1,NTOT
      IF (ATNUM(I).LT.NPAR) GOTO 104
      IF (ATWT(I).LT.IWTPAR) GOTO 104
      IF ((ATNUM(I).GT.MAXN).OR.((ATNUM(I).EQ.MAXN).AND.
     1  (ATWT(I).GT.MAXW))) GOTO 105
      IF(ATWT(I).GT.MAXW) GOTO 104
      N=N+1
      NAT(N)=ATNUM(I)
      A(N)=ATWT(I)
      NI(N)=I
      ENCODE (8,1100,NAMEN) NAT(N),NME(I),A(N)
      NAME(N)=NAMEN(1)
1100  FORMAT (I3,A2,I3)
      ALAM(N)=THALF(I)
      BSIG(N)=SIG(I)
      BSIGF(N)=SIGFS(I)
      IF ((ATNUM(I).EQ.MAXN).AND.(ATWT(I).EQ.MAXW)) GOTO 105
104   CONTINUE
      PRINT 1003
1003  FORMAT (/'DATA FILE DOES NOT CONTAIN PARENT AND'
     2,'/OR MAX Z OR A TOO LARGE')
      CALL EXIT
105   CONTINUE
      DO 3 I=1,N
      DO 3 J=1,N
3     ACO(I,J)=0.0
      PHI=(3600.0)*Z
      XLOG=ALOG(2.0)
      DO 5 L=1,N
      XLAM=0.
      IF (ALAM(L).NE.0.) XLAM=XLOG/ALAM(L)
      XABS=BSIG(L)*PHI
      XABSF=BSIGF(L)*PHI
      CHIR(L)=-(XLAM+XABS+XABSF)
      IF (XABS.NE.0..AND.A(L).NE.MAXW) ACO(L+1,L)=XABS
      IF (XLAM.EQ.0..OR.NAT(L).EQ.MAXN) GOTO 5
      LP=L+1
      DO 6 K=LP,N
      IF ((NAT(K).NE.NAT(L)+1).OR.(A(K).NE.A(L))) GOTO 6
      ACO(K,L)=XLAM
      GOTO 5
6     CONTINUE
      PRINT 1004,NAME(L)
1004  FORMAT(/'DATA FILE INCOMPLETE   ',A8)
      GOTO 5
306   PRINT 350
      GOTO 306
313   PRINT 350
      GOTO 314
```

```
350   FORMAT ('WHAT?')
5     CONTINUE
17    CALL EXMA(ACO,N)
20    DO 21 I=1,N
      DO 21 J=1,I
      IF (QCO(I,J).EQ.0.) GOTO 21
      WRITE (6,3003) NI(1),NI(I),NI(J),QCO(I,J)
      SUBROUTINE MAIN
      DIMENSION TMAT(250,40),EV(250),DLAM(250),
     2   TMATD(250,40),AMT(250),DUMP(250),V(250),EVZ(250)
      REAL*8 ISO,FILE
      COMMON /LIMITS/NLOW,NHIGH,NBAD,NBN,NBB,BL,BNL,BBL
      COMMON/TMATS/TMATS(250,40)
      COMMON/TOPES/IA(250),IZ(250),ISO(250),N,ALOSS
      COMMON/TOTS/AN,FISS
$INSERT SYSCOM>KEYS.F
$INSERT SYSCOM>ERRD.F
      CALL SRCH$$(K$DELE,'OUT',3,0,IT,IC)
      CALL SRCH$$(K$WRIT,'OUT',3,4,IT,IC)
      LENGTH=8
200   PRINT 1029
1029  FORMAT (/'INPUT NLOW,NHIGH')
      READ (1,*,ERR=200) NLOW,NHIGH
1     PRINT 1000
1000  FORMAT (/'CHOOSE OPTION FOR TRANSITION MATRIX FOR IRRADIATION'
     2  /'1. NO IRRADIATION, DTIR=0.'/'2. CALCULATE THE MATRIX'/
     3 '3. INPUT THE MATRIX'/'4. LEAVE AS IS')
202   READ (1,*,ERR=2020) IOP
      GOTO (61,62,63,64),IOP
2020  PRINT 1004
1004  FORMAT ('SPECIFY BY NUMBER (INTEGER)')
      GOTO 202
61    DTIR=0.
      GOTO 74
62    PRINT 1005
1005  FORMAT (/'INPUT TIME STEP FOR IRRADIATION')
      READ (1,*,ERR=62) DTIR
      IF (DTIR.EQ.0.) GOTO 74
      PRINT 1006
1006  FORMAT (/ 'COEFFICIENT MATRIX FOR IRRADIATION')
204   PRINT 1001
1001  FORMAT (/'INPUT FILE NAME')
      READ (1,1002,ERR=204) FILE
1002  FORMAT (A8)
      CALL TRMUTE (TMAT,EV,FLUX,DLAM,DTIR,FILE,LENGTH,LMAX)
      GOTO 64
63    PRINT 1007
1007  FORMAT (/'IRRADIATION TRANSITION MATRIX')
      PRINT 1001
      READ (1,1002,ERR=63) FILE
      CALL INMAT (TMAT,EV,FLUX,DLAM,DTIR,FILE,LENGTH,LMAX)
64    PRINT 1008,DTIR
1008  FORMAT (/'CHOOSE OPTION 2,3,OR 4 FOR NO FLUX, DTIR=  ',F7.3)
      READ (1,*,ERR=64) IOP
      GOTO (64,72,73,74),IOP
      PRINT 1004
      GOTO 64
72    CALL ZMUTE (TMATD,EVZ,FLZERO,DLAM,DTIR,'NOFLUX',6,LMAXD)
      GOTO 74
73    PRINT 1009, DTIR
1009  FORMAT (/'NO FLUX DECAY MATRIX, DT= ',F7.3)
      PRINT 1001
      READ (1,1002,ERR=73) FILE
```

```
      CALL INMAT (TMATD,EVZ,FLZERO,DLAM,DTIREQ,FILE,LENGTH,LMAXD)
      IF (DTIREQ.EQ.DTIR) GOTO 74
      PRINT 1010
1010  FORMAT ('WRONG TIME INTERVAL')
      GOTO 64
74    PRINT 1011
1011  FORMAT (/'CHOOSE OPTION 1-4 FOR NO-FLUX STANDING MATRIX')
      READ (1,*,ERR=74) IOP
      GOTO (81,82,83,84),IOP
      PRINT 1004
      GOTO 74
81    DTST=0.
      GOTO 84
82    PRINT 1012
1012  FORMAT (/'INPUT STANDING TIME STEP')
      READ (1,*,ERR=82) DTST
      IF (DTST.EQ.0.) GOTO 84
      CALL ZMUTE (TMATS,EVZ,FLZERO,DLAM,DTST,'NOFLUX',6,LMAXD)
      GOTO 84
83    PRINT 1013
1013  FORMAT (/'NOFLUX STANDING MATRIX')
      PRINT 1001
      READ (1,1002,ERR=83) FILE
      CALL INMAT(TMATS,EVZ,FLZERO,DLAM,DTST,FILE,LENGTH,LMAXD)
84    PRINT 1014
1014  FORMAT (/'CHOOSE OPTION FOR CONCENTRATIONS:'/
     2   '1. INPUT'/'2. LEAVE AS IS')
      READ (1,*,ERR=84) IOP
      GOTO (91,92),IOP
      PRINT 1004
      GOTO 84
91    PRINT 1001
      READ (1,1002,ERR=91) FILE
      CALL INAMT (AMT,FILE,LENGTH)
92    PRINT 1015
1015  FORMAT (/'CHOOSE OPTION FOR DUMP:'/'1. INPUT'/
     2   '2. LEAVE AS IS'/'3. SET TO ZERO')
      READ (1,*,ERR=92) IOP
      GOTO (93,94,95),IOP
      PRINT 1004
      GOTO 92
95    DO 96 J=NLOW,NHIGH
96    DUMP(J)=0.
      GOTO 94
93    PRINT 1001
      READ (1,1002,ERR=93) FILE
      CALL INAMT(DUMP,FILE,LENGTH)
94    PRINT 1016
1016  FORMAT (/'CHOOSE OPTION 1,2,OR 3 FOR CHEMICAL PROCESSING')
      READ (1,*,ERR=94) IOP
      GOTO (101,102,103),IOP
      PRINT 1004
      GOTO 94
99    PRINT 1031,K,V(K)
1031  FORMAT ('ERROR IN CHEMICAL PROCESSING FILE:'
     2/'V(',I3') = ',F6.3)
      GOTO 94
103   DO 104 J=NLOW,NHIGH
104   V(J)=0.
      GOTO 102
101   PRINT 1001
      READ (1,1002,ERR=101) FILE
      CALL INAMT (V,FILE,LENGTH)
      DO 98 K=NLOW,NHIGH
98    IF (V(K).LT.0..OR.V(K).GT.1.0) GOTO 99
102   PRINT 1017,T
1017  FORMAT (/'CURRENTLY T=',F10.3/'INPUT THE VALUE YOU ',
     2   'WANT T TO HAVE')
      READ (1,*,ERR=102) T
      AN=ATWT
```

```
97      PRINT 1030,AN
1030    FORMAT (/'CURRENTLY NUMBER OF NEUTRONS USED =',F9.5/
       2   'INPUT THE VALUE YOU WANT IT TO BE.')
        READ (1,*,ERR=97) AN
111     PRINT 1032 FISS
1032    FORMAT (/'CURRENTLY AMOUNT FISSIONED =',F9.5/
       2    'INPUT THE VALUE YOU WANT IT TO BE')
        READ (1,*,ERR=111)FISS
        PRINT 1018
1018    FORMAT(/'DO YOU WANT CHEMICAL PROCESSING BEFORE',
       2    ' FIRST IRRADIATION?')
        READ (1,1019) ANSW
1019    FORMAT (A1)
        IF (ANSW.EQ.'N') GOTO 105
        CALL PROCES(V,AMT,DUMP,N)
105     PRINT 1020
1020    FORMAT (/'INPUT NUMBER OF STEPS, FREQUENCY OF OUTPUT')
        READ (1,*,ERR=105) NT,NTPR
        CALL RUNDAT(FLUX,DTIR,DTST,NLOW,NHIGH,ISO(NLOW),ISO(NHIGH),
       2   T,NT,NTPR,AN,FISS)
        CALL PRAMT (AMT,DUMP,DLAM,ATWTI,ATWT,T,FLUX)
        NTAL=0
        DO 2 J=1,NT
        T=T+DTIR
        CALL NEWCON(TMATD,DUMP,N,LMAXD,DTIR,0.)
        CALL NEWCON(TMAT,AMT,N,LMAX,DTIR,FLUX)
        T=T+DTST
        CALL NEWCON(TMATS,DUMP,N,LMAXD,DTST,0.)
        CALL NEWCON(TMATS,AMT,N,LMAXD,DTST,0.)
        CALL PROCES(V,AMT,DUMP,N)
        NTAL=NTAL+1
        IF (NTAL.LT.NTPR) GOTO 2
        NTAL=0
        CALL PRAMT(AMT,DUMP,DLAM,ATWTI,ATWT,T,FLUX)
2       CONTINUE
        PRINT 1021
1021    FORMAT (/'ANSWER YES OR NO TO THE FOLLOWING QUESTIONS'/
       2'1. SHOULD THE IRRADIATION TRANSITION MATRIX BE SAVED?')
        READ (1,1019) ANSW
        IF (ANSW.EQ.'N') GOTO 106
        CALL OUTMAT(TMAT,EV,DLAM,DTIR,FLUX,LMAX)
106     PRINT 1022
        SUBROUTINE MAIN


1022    FORMAT(/'2. SHOULD THE DUMP TRANSITION MATRIX BE SAVED?')
        READ (1,1019)ANSW
        IF (ANSW.EQ.'N') GOTO 107
        CALL OUTMAT (TMATD,EVZ,DLAM,DTIR,FLZERO,LMAXD)
107     PRINT 1023
1023    FORMAT (/'3. SHOULD THE STANDING TRANSITION MATRIX BE SAVED?')
        READ (1,1019) ANSW
        IF (ANSW.EQ.'N') GOTO 108
        CALL OUTMAT (TMATS,EVZ,DLAM,DTST,FLZERO,LMAXD)
108     PRINT 1024
1024    FORMAT (/'4. SHOULD CONCENTRATIONS BE SAVED?')
        READ (1,1019) ANSW
        IF (ANSW.EQ.'N') GOTO 109
        CALL OUTAMT(AMT)
109     PRINT 1025
1025    FORMAT (/'5. SHOULD DUMP BE SAVED?')
        READ (1,1019) ANSW
        IF (ANSW.EQ.'N') GOTO 110
        CALL OUTAMT(DUMP)
110     PRINT 1026
1026    FORMAT (/'6. DO YOU WANT TO CONTINUE?')
        READ (1,1019) ANSW
        IF (ANSW.NE.'N') GOTO 1
```

```
      CALL SRCHSS(KSCLOS,'OUT',3,4,IT,IC)
      PRINT 1027
1027  FORMAT(/'TO SPOOL RESULTS,TYPE:'/'SPOOL OUT -FTN')
      RETURN
      END

      SUBROUTINE TRMUTE(TMAT,EV,FLUX,DLAM,T,FILE,LFILE,LMAX)



      SUBROUTINE TRMUTE(TMAT,EV,FLUX,DLAM,T,FILE,LFILE,LMAX)
      DIMENSION TMAT(250,40),EV(250),DLAM(250),EEVT(250)
     2,  DLFIS(250),DLABS(250),EIT(250)
      COMMON /LIMITS/NLOW,NHIGH,NBAD,NBN,NBB,BL,BNL,BBL
      COMMON/TOPES/IA(250),IZ(250),ISO(250),N,ALOSS
      COMMON/AMTS/FACT,DNEUT(250),ANEUT(250),FISS(250)
      REAL*8 FILE,ISO,EL,ISOT(1)
$INSERT SYSCOM>KEYS.F
$INSERT SYSCOM>ERRD.F
7     CALL SRCHSS(KSREAD,FILE,LFILE,2,IT,IC)
      IF (IC.EQ.0) GOTO 6
8     PRINT 1004 FILE
1004  FORMAT ('UNABLE TO OPEN FILE ***,A8,****
     2  /'INPUT FILE NAME')
      READ (1,1006,ERR=8) FILE
1006  FORMAT (A8)
      GOTO 7
6     READ (6,1000) FLUX
      NBN=-1
      NBB=-1
      UNIT=1.
      FACT=1.44
1000  FORMAT (2E14.7)
      FLUX=3600.*FLUX
      XLOG=ALOG(2.)
      CALL SRCHSS(KSREAD,'DATA',4,1,IT,IC)
      DO 1 N=1,250
      READ (5,1001) IZ(N),EL,IA(N),TH,SIG,SIGF
1001  FORMAT (3X,I3,A2,I3,3E11.4)
      IF (N.LT.NLOW) GOTO 1
      IF (N.GT.NHIGH) GOTO 2
      IF (EL.EQ.'  ') GOTO 2
      ENCODE (8,1002,ISOT) IZ(N),EL,IA(N)
1002  FORMAT (I3,A2,I3)
      ISO(N)=ISOT(1)
      IF (TH.EQ.0.)GO TO 10
      DLAM(N)=XLOG/TH
11    DLFIS(N)=SIGF*FLUX/1.E24
      DLABS(N)=SIG*FLUX/1.E24
      DNEUT(N)=DLABS(N)-FACT*DLFIS(N)
      EV(N)=-(DLAM(N)+DLABS(N)+DLFIS(N))
      IF (EV(N).EQ.0) GOTO 14
      EEVT(N)=ZEXP(EV(N)*T)
      EIT(N)=-(1.-EEVT(N))/EV(N)
1     CONTINUE
      N=N+1
2     N=N-1
18    PRINT 1007
1007  FORMAT ('INPUT NBAD')
      READ (1,*,ERR=18) NBAD
      BL=EV(NBAD)
      DO 3 I=1,N
      ANEUT(I)=0.
      FISS(I)=0.
      DO 3 L=1,40
3     TMAT(I,L)=0.
```

```
      LMAX=0
4     READ (6,1003) I,J,K,AMT
      IF (J.EQ.NBAD) GOTO 15
1003  FORMAT(3I4,E15.7)
16    IF (I.EQ.0.OR.I.GT.NHIGH) GOTO 5
      IF (I.LT.NLOW) GOTO 4
      IF (J.GT.NHIGH) GO TO 4
      L=J-I+1
      LMAX=MAX(L,LMAX)
      X=AMT*EEVT(K)/UNIT
      Y=AMT*EIT(K)/UNIT
      TMAT(I,L)=TMAT(I,L)+X
      ANEUT(I)=ANEUT(I)+DNEUT(J)*Y
      FISS(I)=FISS(I)+DLFIS(J)*Y
      GOTO 4
5     CALL SRCHSS(K$CLOS,FILE,LFILE,2,IT,IC)
      CALL SRCHSS(K$CLOS,'DATA',4,1,IT,IC)
      DO 12 J=NLOW,NHIGH
      SUM=FISS(J)
      DO 13 K=1,LMAX
      IF (TMAT(J,K).LT.0.) TMAT(J,K)=0.
      SUM=SUM+TMAT(J,K)
13    CONTINUE
      X=1.-SUM
      IF (ABS(X).GT..001) PRINT 1005 J,X
      TMAT(J,40)=X*IA(J)
12    CONTINUE
1005  FORMAT(/'SUM TMAT(',I3,',K)=1-',E10.3)
      CALL TMATP(TMAT,EV,DLAM,T)
      RETURN
10    DLAM(N)=0.
      GOTO 11
14    EEVT(N)=1.
      EIT(N)=T
      GOTO 1
15    IF (IZ(J)+IA(J)-IZ(I)-IA(I).NE.1) GOTO 16
      IF (IZ(J).EQ.IZ(I))GOTO 17
      NBB=I
      BBL=DLAM(I)
      GOTO 16
17    NBN=I
      BNL=DLABS(I)
      GOTO 16
      END
      SUBROUTINE ZMUTE(TMAT,EV,FLUX,DLAM,T,FILE,LFILE,LMAX)
      DIMENSION TMAT(250,40),EV(250),DLAM(250),EEVT(250)
      COMMON /LIMITS/NLOW,NHIGH
      COMMON/TOPES/IA(250),IZ(250),ISO(250),N,ALOSS
      REAL*8 FILE,ISO,EL,ISOT(1)
$INSERT SYSCOM>KEYS.F
$INSERT SYSCOM>ERRD.F
7     CALL SRCHSS(K$READ,FILE,LFILE,2,IT,IC)
      IF (IC.EQ.0) GOTO 6
8     PRINT 1004, FILE, LENGTH
1004  FORMAT ('UNABLE TO OPEN FILE ***',A8,'*** OF LENGTH'
     2,I2/'INPUT **FILE**,LENGTH')
      READ (1,*,ERR=8) FILE,LENGTH
      GOTO 7
6     READ (6,1000) FLUX
      UNIT=1.
1000  FORMAT (2E14.7)
      FLUX=3600.*FLUX
      XLOG=ALOG(2.)
      CALL SRCHSS(K$READ,'DATA',4,1,IT,IC)
      DO 1 N=1,250
      READ (5,1001) IZ(N),EL,IA(N),TH,SIG
1001  FORMAT (3X,I3,A2,I3,2E11.4)
      IF (N.LT.NLOW) GOTO 1
      IF (N.GT.NHIGH) GOTO 2
      IF (EL.EQ.'  ') GOTO 2
```

```
      ENCODE (8,1002,ISOT) IZ(N),EL,IA(N)
1002  FORMAT (I3,A2,I3)
      ISO(N)=ISOT(1)
      IF (TH.EQ.0.)GO TO 10
      DLAM(N)=XLOG/TH
11    EV(N)=-(DLAM(N)+SIG*FLUX/1.E24)
      EEVT(N)=ZEXP(EV(N)*T)
1     CONTINUE
      N=N+1
2     N=N-1
      DO 3 I=1,N
      DO 3 L=1,40
3     TMAT(I,L)=0.
      LMAX=0
4     READ (6,1003) I,J,K,AMT
1003  FORMAT(3I4,E15.7)
      IF (I.EQ.0.OR.I.GT.NHIGH) GOTO 5
      IF (I.LT.NLOW) GOTO 4
      IF (J.GT.NHIGH) GO TO 4
      L=J-I+1
      LMAX=MAX(L,LMAX)
      TMAT(I,L)=TMAT(I,L)+AMT*EEVT(K)/UNIT
      GOTO 4
5     CALL SRCH$$(K$CLOS,FILE,LFILE,2,IT,IC)
      CALL SRCH$$(K$CLOS,'DATA',4,1,IT,IC)
      DO 12 J=NLOW,NHIGH
      SUM=0
      DO 13 K=1,LMAX
      IF (TMAT(J,K).LT.0.) TMAT(J,K)=0.
      SUM=SUM+TMAT(J,K)
13    CONTINUE
      X=1.-SUM
      IF (ABS(X).GT..001) PRINT 1005 J,X
      TMAT(J,40)=X*IA(J)
12    CONTINUE
1005  FORMAT(/'SUM TMAT(',I3,',K)=1-',E10.3)
      CALL TMATP(TMAT,EV,DLAM,T)
      RETURN
10    DLAM(N)=0.
      GOTO 11
      END

      SUBROUTINE NEWCON(TMAT,CON,NN,LMAX,DT,FLUX)
```

```
      SUBROUTINE NEWCON(TMAT,CON,NN,LMAX,DT,FLUX)
      DIMENSION TMAT(250,40),CON(250),TCON(250)
      REAL*8 ISO
      COMMON /LIMITS/NLOW,NHIGH,NBAD,NBN,NBB,BL,BNL,BBL
      COMMON/TOPES/IA(250),IZ(250),ISO(250),N,ALOSS
      COMMON/AMTS/FACT,DN(250),AN(250),FI(250)
      COMMON/TOTS/AMTN,AMTF
      IF (DT.EQ.0.) RETURN
      DO 1 J=NLOW,NHIGH
      TCON(J)=0.
      DO 1 L=1,LMAX
      I=J-L+1
      IF (I.LT.NLOW) GOTO 1
      TCON(J)=TCON(J)+TMAT(I,L)*CON(I)
1     CONTINUE
      DO 2 I=NLOW,NHIGH
      ALOSS=ALOSS+TMAT(I,40)*CON(I)
      IF (FLUX.EQ.0.) GOTO 2
      AMTN=AMTN+AN(I)*CON(I)
      AMTF=AMTF+FI(I)*CON(I)
2     CON(I)=TCON(I)
      RETURN
      END
```

```
      SUBROUTINE PRAMT (AMT,DUMP,DLAM,ATWTI,ATWT,T,FLUX)


      SUBROUTINE PRAMT (AMT,DUMP,DLAM,ATWTI,ATWT,T,FLUX)
      DIMENSION AMT(250),DUMP(250),DLAM(250)
      REAL *8 ISO
      COMMON /LIMITS/NLOW,NHIGH,NBAD,NBN,NBB,BL,BNL,BBL
      COMMON/TOPES/IA(250),IZ(250),ISO(250),N,ALOSS
      COMMON/TOTS/AN,AF
      COMMON/AMTS/FACT,DNU(250),ANU(250),AFS(250)
      CALL ACT(AMT,DUMP,DLAM,ACTIV,N)
      DB=BL*AMT(NBAD)
      IF (NBN.GT.0) DB=DB+BNL*AMT(NBN)
      IF (NBB.GT.0) DB=DB+BBL*AMT(NBB)
      DN=0.
      DO 2 J=NLOW,NHIGH
2     DN=DN+DNU(J)*AMT(J)
      DNDB=999999.9
      IF (DB.NE.0.) DNDB=DN/DB
      WRITE (8,1000) T,FLUX,ACTIV,AN
1000  FORMAT ('1AMOUNTS AT T=',F8.1,'HOURS.  FLUX=',E10.3
     2, '.  ACTIVITY=',E10.3,'. NEUTRONS USED =',E12.5,'.')
      WRITE (8,1003) DNDB,AF
1003  FORMAT (' D NEUT/D BAD =',E12.5,'  FISSIONS =',E12.5)
      NN=NHIGH-NLOW+1
      NL = (NN+11)/12
      DO 1 JL=1,NL
      JMIN =JL*12-12+NLOW
      JMAX =JL*12-1+NLOW
      IF (JL.EQ.NL) JMAX=NHIGH
      WRITE (8,1001) (ISO(J), J=JMIN,JMAX)
      WRITE (8,1002) (AMT(J),J=JMIN,JMAX)
      WRITE (8,1002) (DUMP(J), J=JMIN,JMAX)
1001  FORMAT (/,12(X,A8,X))
1002  FORMAT (12E10.3)
1     CONTINUE
      RETURN
      END
      SUBROUTINE RUNDAT (FLUX,DTIR,DTST,NL,NH,A,B,T,NT,NP,AN,F)


      SUBROUTINE RUNDAT (FLUX,DTIR,DTST,NL,NH,A,B,T,NT,NP,AN,F)
      REAL*8 A,B
$INSERT SYSCOM>KEYS.F
$INSERT SYSCOM>ERRD.F
      CALL SRCHSS(K$RDWR,'RUN#',4,2,IT,IC)
      READ (6,1000) NUM
1000  FORMAT (I6)
      NUM=NUM+1
      REWIND 6
      WRITE (6,1000) NUM
      CALL SRCHSS(K$CLOS,'RUN#',4,2,IT,IC)
      TEND=T+(DTIR+DTST)*NT
      TPRINT=NP*(DTIR+DTST)
      DO 1 J=1,2
1     WRITE (8,1001)NUM,FLUX,DTIR,DTST,NL,A,NH,B,T,TEND,AN,F,TPRINT
      RETURN
1001  FORMAT('1RUN NUMBER',14X,I6/' FLUX',16X,E10.4/' IRRADIATION TIME'
     2,4X,E10.4/' REST TIME',11X,E10.4/' ISOTOPE RANGE',7X,I3,2X,A8,
     3 '  TO  ',I3,2X,A8/
     4/' STARTING TIME',7X,E10.4/' ENDING TIME',9X,E10.4/
     5,' STARTING NEUTRONS   ',E10.4/' STARTING FISSIONS   ',E10.4
     6/' PRINT TIME INTERVAL ',E10.4)
      END
```

```
      SUBROUTINE INMAT(TMAT,EV,FLUX,DLAM,DT,FILE,LENGTH,LMAX)


      SUBROUTINE INMAT(TMAT,EV,FLUX,DLAM,DT,FILE,LENGTH,LMAX)
      DIMENSION TMAT(250,40),EV(250),DLAM(250)
      REAL*8 ISO,FILE
      COMMON /LIMITS/NLOW,NHIGH,N1,N2,N3,B1,B2,B3
      COMMON/TOPES/IA(250),IZ(250),ISO(250),N,ALOSS
      COMMON/AMTS/FACT,DN(250),AN(250),FI(250)
$INSERT SYSCOM>KEYS.F
$INSERT SYSCOM>ERRD.F
7     CALL SRCH$$(K$READ,FILE,LENGTH,2,IT,IC)
      IF (IC.EQ.0) GOTO 6
8     PRINT 1004, FILE
1004  FORMAT ('UNABLE TO OPEN FILE ***',A8,'***
     2   /'INPUT FILE NAME')
      READ (1,1005,ERR=8) FILE
1005  FORMAT (A8)
      GOTO 7
6     READ (6,1000) NL,NH,LMAX,DT,FLUX,FACT
      READ (6,1000) N1,N2,N3,B1,B2,B3
1000  FORMAT (3I4,3E20.7)
      IF (NLOW.LT.NL.OR.NHIGH.GT.NH) GOTO 99
      DO 1 J=NL,NH
1     READ(6,1001) JJ,ISO(J),IZ(J),IA(J),EV(J),DLAM(J),TMAT(J,40),
     2  DN(J),AN(J),FI(J),(TMAT(J,K),K=1,LMAX)
1001  FORMAT (I3,A8,2I4,3E20.7/3E20.7/8(5E20.7/))
      CALL SRCH$$(K$CLOS,FILE,LENGTH,2,IT,IC)
      RETURN
99    PRINT 1002
1002  FORMAT (/'FATAL ERROR: FILE DOES NOT CONTAIN NLOW < N < NHIGH')
      STOP
      END
      SUBROUTINE OUTMAT(TMAT,EV,DLAM,DT,FLUX,LMAX)
      DIMENSION TMAT(250,40),EV(250),DLAM(250)
      REAL*8 ISO,FILE
      COMMON /LIMITS/NLOW,NHIGH,N1,N2,N3,B1,B2,B3
      COMMON/TOPES/IA(250),IZ(250),ISO(250),N,ALOSS
      COMMON/AMTS/FACT,DN(250),AN(250),FI(250)
$INSERT SYSCOM>KEYS.F
$INSERT SYSCOM>ERRD.F
      LENGTH=8
1     PRINT 1000
1000  FORMAT ('INPUT FILE NAME')
      READ (1,1005,ERR=1) FILE
7     CALL SRCH$$(K$WRIT,FILE,LENGTH,2,IT,IC)
      IF (IC.EQ.0) GOTO 6
8     PRINT 1004, FILE
1004  FORMAT ('UNABLE TO OPEN FILE ***',A8,'***
     2   /'INPUT FILE NAME')
      READ (1,1005,ERR=8) FILE
1005  FORMAT (A8)
      GOTO 7
6     WRITE (6,1001) NLOW,NHIGH,LMAX,DT,FLUX,FACT
      WRITE (6,1001) N1,N2,N3,B1,B2,B3
1001  FORMAT (3I4,3E20.7)
      LMXF=LMAX/5
      LMXF=5*LMXF-LMAX
      DO 2 J=NLOW,NHIGH
```

```
      WRITE (6,1002) J,ISO(J),IZ(J),IA(J),EV(J),
     2  DLAM(J),TMAT(J,40),DN(J),AN(J),FI(J),(TMAT(J,K),K=1,LMAX)
1002  FORMAT (I3,A8,2I4,3E20.7/3E20.7/8(5E20.7/))
      IF (LMXF.EQ.0) WRITE (6,1003)
1003  FORMAT (' ')
2     CONTINUE
      CALL SRCHSS(KSCLOS,FILE,LENGTH,2,IT,IC)
      RETURN
      END
      SUBROUTINE INAMT(AMT,FILE,LENGTH)
      DIMENSION AMT(250)
      REAL*8 ISO,FILE
      COMMON /LIMITS/NLOW,NHIGH,N1,N2,N3,B1,B2,B3
      COMMON/TOPES/IA(250),IZ(250),ISO(250),N,ALOSS
$INSERT SYSCOM>KEYS.F
$INSERT SYSCOM>ERRD.F
7     CALL SRCHSS(KSREAD,FILE,LENGTH,2,IT,IC)
      IF (IC.EQ.0) GOTO 6
8     PRINT 1004, FILE
1004  FORMAT ('UNABLE TO OPEN FILE ***',A8,'***
     2   /'INPUT FILE NAME')
      READ (1,1003,ERR=8) FILE
1003  FORMAT (A8)
      GOTO 7
6     READ (6,1000) NL,NH
1000  FORMAT (2I4)
      IF (NLOW.LT.NL.OR.NHIGH.GT.NH) GOTO 99
      DO 1 J=NL,NH
1     READ(6,1001) JJ,ISO(J),AMT(J)
1001  FORMAT (I3,A8,E20.7)
      CALL SRCHSS(KSCLOS,FILE,LENGTH,2,IT,IC)
      RETURN
99    PRINT 1002
1002  FORMAT (/'FATAL ERROR: FILE DOES NOT CONTAIN NLOW < N < NHIGH')
      STOP
      END
      SUBROUTINE OUTAMT(AMT)
      DIMENSION AMT(250)
      REAL*8 ISO,FILE
      COMMON /LIMITS/NLOW,NHIGH,N1,N2,N3,B1,B2,B3
      COMMON/TOPES/IA(250),IZ(250),ISO(250),N,ALOSS
$INSERT SYSCOM>KEYS.F
$INSERT SYSCOM>ERRD.F
1     PRINT 1000
1000  FORMAT ('INPUT FILE NAME')
7     READ (1,1003,ERR=1) FILE
1003  FORMAT (A8)
      LENGTH=8
      CALL SRCHSS(KSWRIT,FILE,LENGTH,2,IT,IC)
      IF (IC.EQ.0) GOTO 6
8     PRINT 1004, FILE
1004  FORMAT ('UNABLE TO OPEN FILE ***',A8,'***
     2   /'INPUT FILE NAME')
      GOTO 7
6     WRITE (6,1001) NLOW,NHIGH
1001  FORMAT (2I4)
      DO 2 J=NLOW,NHIGH
2     WRITE (6,1002) J,ISO(J),AMT(J)
1002  FORMAT (I3,A8,E20.7)
      CALL SRCHSS(KSCLOS,FILE,LENGTH,2,IT,IC)
      RETURN
      END
      SUBROUTINE TMATP(TMAT,EV,DLAM,DT)
      DIMENSION TMAT(250,40),EV(250),DLAM(250)
      COMMON/TOPES/IA(250),IZ(250),ISO(250),N,ALOSS
      REAL*8 ISO
      COMMON /LIMITS/NLOW,NHIGH,N1,N2,N3,B1,B2,B3
      COMMON/AMTS/FACT,DNEUT(250),ANEUT(250),FISS(250)
      WRITE (8,1000) DT
      DO 1 J=NLOW,NHIGH
      Z=TMAT(J,40)
```

```
1       WRITE (8,1001) J,ISO(J),EV(J),DLAM(J),Z,DNEUT(J)
       2,ANEUT(J),FISS(J),(TMAT(J,K),K=1,40)
        RETURN
1000    FORMAT (//'1TRANSITION MATRIX FOR DT=',E14.3,'HOURS')
1001    FORMAT (/' SPECIES #',I3,3X,A8,'    EV',E14.5,'    DLAM',
       2   E14.5,   '    LOSS',E14.5,/'DNEUT',E14.5,
       3      '    ANEUT',E14.5,'    FISS',E14.5,4(/1X,12E10.3))
        END
```

A19

```
      SUBROUTINE PROCES(V,A,D,N)


      SUBROUTINE PROCES(V,A,D,N)
      DIMENSION V(250),A(250),D(250)
      COMMON /LIMITS/NLOW,NHIGH,N1,N2,N3,B1,B2,B3
      DO 1 J=NLOW,NHIGH
      X=V(J)*A(J)
      D(J)=D(J)+X
1     A(J)=A(J)-X
      RETURN
      END
      SUBROUTINE ACT(A,D,DECAY,AMT,N)
      DIMENSION A(250),D(250),DECAY(250)
      COMMON /LIMITS/NLOW,NHIGH,N1,N2,N3,B1,B2,B3
      AMT=0.
      DO 1 J=NLOW,NHIGH
1     AMT=AMT+(A(J)+D(J))*DECAY(J)
      RETURN
      END
      FUNCTION MAX(I,J)
      MAX=I
      IF (J.GT.I) MAX=J
      RETURN
      END
      FUNCTION ZEXP(X)
      ZEXP=0.
      IF (X.GT.-1000.) ZEXP=EXP(X)
      RETURN
      END
      SUBROUTINE INDATA


      SUBROUTINE INDATA
      REAL*8 FILE
$INSERT SYSCOM>KEYS.F
$INSERT SYSCOM>ERRD.F
9     PRINT 10
10    FORMAT(/'INPUT FILE NAME')
      READ (1,1000,ERR=9) FILE
      LENGTH=8
1000  FORMAT (A8)
11    PRINT 12
12    FORMAT (/'ENTER NLOW,NHIGH TO BE CHANGED')
      READ (1,*,ERR=11) NLOW,NHIGH
      PRINT 1
1     FORMAT(/'FOR EACH ISOTOPE ENTER HALF LIFE,'
     2,  ' CROSS SECTION, AND FISSION CROSS SECTION')
      CALL SRCH$$(K$READ,'DATA',4,1,IT,IC)
      CALL SRCH$$(K$WRIT,FILE,LENGTH,2,IT,IC)
      ICODE=0
      NN=0
2     READ (5,6) N,B,A,C,X,Y,Z
      NN=NN+1
      IF (A.EQ.'  ') GOTO 7
      IF(N.LT.NLOW.OR.N.GT.NHIGH) GOTO 3
```

```
4       PRINT 6 NN,B,A,C
        READ (1,*,ERR=4) X,Y,Z
3       WRITE (6,6)NN,B,A,C,X,Y,Z
6       FORMAT (2I3,A2,I3,3E11.4)
        GOTO 2
7       B=0
        A='  '
        C=0
        WRITE (6,6)B,B,A,C,C,C
        PRINT 8, FILE
8       FORMAT ('STORED IN FILE ''',A8,'''')
        CALL SRCH$$(K$CLOS,'DATA',4,1,IT,IC)
        CALL SRCH$$(K$CLOS,FILE,LENGTH,2,IT,IC)
        RETURN
        END
        SUBROUTINE INCHA
```

```
        SUBROUTINE INCHA
        DIMENSION ANAME(250),BNAME(250),KK(250)
$INSERT SYSCOM>KEYS.F
$INSERT SYSCOM>ERRD.F
        CALL SRCH$$(K$READ,'DATA',4,1,IT,IC)
        CALL SRCH$$(K$WRIT,'CHAINS',6,2,IT,IC)
        DO 1 J=1,250
        READ (5,100) JJ,ANAME(J),BNAME(J)
        IF (JJ.EQ.0) GOTO 2
4       PRINT 101 J,JJ,ANAME(J),BNAME(J)
101     FORMAT (2I4,2A4)
1       READ (1,*,ERR=4) KK(J)
2       DO 3 JJ=1,J
        KKJ=KK(JJ)
3       WRITE (6,102) ANAME(JJ),BNAME(JJ),ANAME(KKJ),BNAME(KKJ)
        CALL SRCH$$(K$CLOS,'DATA',4,1,IT,IC)
        CALL SRCH$$(K$CLOS,'CHAINS',6,2,IT,IC)
        RETURN
100     FORMAT(I3,2A4)
102     FORMAT('FROM ',2A4,' TO ',2A4)
        END
       SUBROUTINE INCASE
```

```
        SUBROUTINE INCASE
        REAL*8 FILE
$INSERT SYSCOM>KEYS.F
$INSERT SYSCOM>ERRD.F
9       PRINT 10
10      FORMAT(/'INPUT FILE NAME')
        READ (1,4321,ERR=9) FILE
4321    FORMAT (A8)
        LENGTH=8
11      PRINT 12
12      FORMAT (/'ENTER NLOW,NHIGH')
        READ (1,*,ERR=11) NLOW,NHIGH
        PRINT 1
1       FORMAT(/'FOR EACH ISOTOPE ENTER INITIAL CONCENTRATION'
       2,  ' OR FRACTION DUMPED')
        CALL SRCH$$(K$READ,'DATA',4,1,IT,IC)
        CALL SRCH$$(K$WRIT,FILE,LENGTH,2,IT,IC)
        WRITE (6,13) NLOW,NHIGH
13      FORMAT (2I4)
        IF (NLOW.EQ.1) GOTO 2
        NLM=NLOW-1
        DO 14 J=1,NLM
14      READ (5,15) JJ
15      FORMAT (I3)
2       READ (5,3) N,B,A,C
3       FORMAT ( 2I3,A2,I3)
        IF (A.EQ.'  ') GOTO 7
4       PRINT 3 N,B,A,C
```

```
      READ (1,*,ERR=4) X
      WRITE (6,6)N,B,A,C,X
6     FORMAT (2I3,A2,I3,E20.7)
      IF (N.LT.NHIGH) GOTO 2
7     B=0
      A=*  *
      C=0
      WRITE (6,6)B,B,A,C,C
      PRINT 8, FILE
8     FORMAT ('STORED IN FILE ***',A8,'***')
      CALL SRCHSS(KSCLOS,'DATA',4,1,IT,IC)
      CALL SRCHSS(KSCLOS,FILE,LENGTH,2,IT,IC)
      RETURN
      END
      SUBROUTINE NUCL
      SUBROUTINE NUCL
      DIMENSION ITAB(50,150),JTAB(6,8,20),JZ(6,8,20),NM(6,8,20)
      DIMENSION IZ(225),IEL(225),IA(225),HL(225),CCS(225),YIELD(225)
      DIMENSION IS(225),AYIEL(6,8,20),JBUF(120),JD(15),JS(6,8,20)
      DIMENSION JEL(6,8,20),JA(6,8,20),AHL(6,8,20),ACCS(6,8,20)
      DIMENSION LINE(120)
      INTEGER*2 ID(8)
$INSERT SYSCOM>KEYS.F
$INSERT SYSCOM>ERRD.F
      CALL SRCHSS(KSREAD,'DATA',4,2,IT,IC)
      CALL SRCHSS(KSREAD,'INCON',5,4,IT,IC)
      CALL SRCHSS(KSREAD,'FOUT',4,5,IT,IC)
      CALL SRCHSS(KSWRIT,'DOUT',4,3,IT,IC)
      I=1
101   READ(6,200)NUMB,IZ(I),IEL(I),IA(I),HL(I),CCS(I)
200   FORMAT(2I3,A2,I3,2E11.4)
      IF ( NUMB .EQ. 0) GO TO 100
      I=I+1
      GO TO 101
100   LST=I-1
      DO 102 I=1,LST
      READ(8,201) YIELD(I),IS(I)
201   FORMAT(11X,E20.7,A1)
102   CONTINUE
      DO 10 I=1,50
      DO 11 J=1,150
      ITAB(I,J)=0
11    CONTINUE
10    CONTINUE
      KK=IZ(1)-1
      LL=IA(1)-1
      ITAB(1,1)=1
      DO 40 M=2,LST
      I=IZ(M)-KK
      J=IA(M)-LL
40    ITAB(I,J)=M
      K=1
      IST=1
      JST=1
      DO 20 I=1,6
      DO 21 J=1,8
      I7=7-I
      JTAB(I7,J,1)=ITAB(I,J)
21    CONTINUE
20    CONTINUE
26    ICOUNT=1
      JST=JST+7
23    IF ( ITAB(IST,JST) .NE. 0) GO TO 22
      ICOUNT=ICOUNT+1
      IF ( ICOUNT .EQ. 6) GO TO 27
      IST=IST+1
      GO TO 23
```

```
22      K=K+1
        DO 24 I=1,6
        DO 25 J=1,8
        I7=7-I
        JTAB(I7,J,K)=ITAB(IST+I-1,JST+J-1)
25      CONTINUE
24      CONTINUE
        GO TO 26
27      KLST=K
        DO 50 K=1,KLST
        DO 45 I=1,6
        DO 41 J=1,8
        IF ( JTAB(I,J,K) .EQ. 0) GO TO 41
        JZ(I,J,K)=IZ(JTAB(I,J,K))
        JEL(I,J,K)=IEL(JTAB(I,J,K))
        JA(I,J,K)=IA(JTAB(I,J,K))
        JS(I,J,K)=IS(JTAB(I,J,K))
        AHL(I,J,K)=HL(JTAB(I,J,K))
        ACCS(I,J,K)=CCS(JTAB(I,J,K))
        AYIEL(I,J,K)=YIELD(JTAB(I,J,K))
41      CONTINUE
45      CONTINUE
50      CONTINUE
        DO 500 K=1,KLST
        WRITE(7,1201)K
1201    FORMAT('1','FIGURE 4                    PAGE ',I2)
        DO 501 I=1,6
        IF (K .NE. 1) GO TO 1100
        IF (I .NE. 1) GO TO 1101
1105    DO 1102 NIM=1,9
        READ(9,1103)(LINE(IJI),IJI=1,120)
1103    FORMAT(120A1)
        WRITE(7,1104)(LINE(IJI),IJI=1,120)
1104    FORMAT(120A1)
1102    CONTINUE
        GO TO 501
1101    IF (I .NE. 2) GO TO 1120
        GO TO 1105
1120    IF (I .NE. 3) GO TO 1100
        DO 1106 NIM=1,4
        READ(9,1103)(LINE(IJI),IJI=1,120)
        WRITE(7,1104)(LINE(IJI),IJI=1,120)
1106    CONTINUE
        DO 1107 NIMB=1,5
        WRITE(7,1108)
1108    FORMAT('        ')
1107    CONTINUE
        GO TO 501
1100    DO 800 ILI=1,8
        IF (JTAB(I,ILI,K) .NE. 0) GO TO 550
        IF (ILI .NE. 8) GO TO 800
        DO 803  IJK=1,9
        WRITE(7,802)
802     FORMAT('    ')
803     CONTINUE
        GO TO 501
800     CONTINUE
550     CONTINUE
        DO 502 L=1,9
        DO 553 ND=1,120
553     JBUF(ND)=' '
        DO 504 J=1,8
        DO 503 JJ=1,8
503     ID(JJ)=' '
        IF (JTAB(I,J,K) .EQ. 0) GO TO 650
        IF (L .NE. 1) GO TO 601
        IF (AHL(I,J,K) .EQ. 0.) GO TO 650
        IF (AHL(I,J,K) .LT. .1) GO TO 880
        IF (AHL(I,J,K) .GT. 9990) GO TO 881
        GO TO 650
```

```
880     AH=AHL(I,J,K)
        DO 882 M=1,9
        AH=AH*10.
        IF (AH .GE. 1) NM(I,J,K)=M
        IF (AH .GE. 1) GO TO 883
882     CONTINUE
883     ENCODE(15,884,ID) AH
884     FORMAT(1X,F4.2,11X)
        GO TO 650
881     AH=AHL(I,J,K)
        DO 885 M=1,20
        AH=AH/10.
        IF (AH .LT. 10.) NM(I,J,K)=M
        IF (AH .LT. 10.) GO TO 883
885     CONTINUE
        GO TO 650
601     IF (L .NE. 2) GO TO 602
        IF (AHL(I,J,K) .EQ. 0.) GO TO 650
        IF (AHL(I,J,K) .GE. .1) GO TO 890
        ENCODE(15,891,ID) M
891     FORMAT(3X,'-',I1,11X)
        GO TO 650
890     IF (AHL(I,J,K) .GE. 1.) GO TO 892
        ENCODE(15,893,ID)AHL(I,J,K)
893     FORMAT(1X,F4.3,11X)
        GO TO 650
892     IF (AHL(I,J,K) .GE. 10) GO TO 894
        ENCODE(15,895,ID) AHL(I,J,K)
895     FORMAT(1X,F4.2,11X)
        GO TO 650
894     IF (AHL(I,J,K) .GE. 100) GO TO 896
        ENCODE(15,897,ID) AHL(I,J,K)
897     FORMAT(1X,F4.1,11X)
        GO TO 650
896     IF (AHL(I,J,K) .GE. 1000) GO TO 898
        ENCODE(15,899,ID) AHL(I,J,K)
899     FORMAT(2X,I3,11X)
        GO TO 650
898     IF (AHL(I,J,K) .GE. 10000) GO TO 900
        ENCODE(15,901,ID) AHL(I,J,K)
901     FORMAT(1X,I4,11X)
        GO TO 650
900     IF (NM(I,J,K) .GT. 9) GO TO 902
        ENCODE(15,903,ID) NM(I,J,K)
903     FORMAT(4X,I1,11X)
        GO TO 650
902     ENCODE(15,904,ID) NM(I,J,K)
904     FORMAT(3X,I2,11X)
        GO TO 650
602     IF (L .NE. 3) GO TO 603
        IF (AHL(I,J,K) .EQ. 0) GO TO 650
        IF (AHL(I,J,K) .GE. .1) GO TO 910
912     ENCODE(15,911,ID)
911     FORMAT('*10',13X)
        GO TO 650
910     IF (AHL(I,J,K) .LT. 10000) GO TO 650
        IF (M .GT. 9) GO TO 912
        ENCODE(15,913,ID)
913     FORMAT(' *10',12X)
        GO TO 650
603     IF (L .NE. 4) GO TO 604
        GO TO 650
604     IF (L .NE. 5) GO TO 605
        IF (JA(I,J,K) .LT. 100) GO TO 661
        ENCODE(15,660,ID) JA(I,J,K)
660     FORMAT(6X,I3,6X)
        GO TO 650
661     ENCODE(15,662,ID) JA(I,J,K)
662     FORMAT(6X,I2,7X)
        GO TO 650
605     IF (L .NE. 6) GO TO 606
```

```
      ENCODE(15,663,ID) JEL(I,J,K)
663   FORMAT(4X,A2,9X)
      GO TO 650
606   IF (L .NE. 7) GO TO 607
      IF (ACCS(I,J,K) .NE. 0.) GO TO 1010
      ENCODE(15,664,ID) JZ(I,J,K),JS(I,J,K)
664   FORMAT(2X,I2,4X,A1,6X)
      GO TO 650
1010  IF (ACCS(I,J,K) .GE. .1) GO TO 1011
      ENCODE(15,1012,ID) JZ(I,J,K),JS(I,J,K),ACCS(I,J,K)
1012  FORMAT(2X,I2,4X,A1,1X,F5.4)
      GO TO 650
1011  IF (ACCS(I,J,K) .GE. 1) GO TO 1013
      ENCODE(15,1014,ID) JZ(I,J,K),JS(I,J,K),ACCS(I,J,K)
1014  FORMAT(2X,I2,4X,A1,2X,F4.3)
      GO TO 650
1013  IF (ACCS(I,J,K) .GE. 10) GO TO 1015
      ENCODE(15,1016,ID) JZ(I,J,K),JS(I,J,K),ACCS(I,J,K)
1016  FORMAT(2X,I2,4X,A1,2X,F4.2)
      GO TO 650
1015  IF (ACCS(I,J,K) .GE. 100) GO TO 1017
      ENCODE(15,1018,ID) JZ(I,J,K),JS(I,J,K),ACCS(I,J,K)
1018  FORMAT(2X,I2,4X,A1,2X,F4.1)
      GO TO 650
1017  IF (ACCS(I,J,K) .GE. 1000) GO TO 1019
      ENCODE(15,1020,ID) JZ(I,J,K),JS(I,J,K),ACCS(I,J,K)
1020  FORMAT(2X,I2,4X,A1,2X,I3,1X)
      GO TO 650
1019  IF (ACCS(I,J,K) .GE. 10000) GO TO 1021
      ENCODE(15,1022,ID) JZ(I,J,K),JS(I,J,K),ACCS(I,J,K)
1022  FORMAT(2X,I2,4X,A1,2X,I4)
      GO TO 650
1021  IF (ACCS(I,J,K) .GE. 100000) GO TO 1023
      ENCODE(15,1024,ID) JZ(I,J,K),JS(I,J,K),ACCS(I,J,K)
1024  FORMAT(2X,I2,4X,A1,1X,I5)
      GO TO 650
1023  AC=ACCS(I,J,K)
      DO 1025 MM=1,9
      AC=AC/10.
      IF ( AC .LT. 10.) GO TO 1026
1025  CONTINUE
1026  ENCODE(15,1027,ID) JZ(I,J,K),JS(I,J,K),AC
1027  FORMAT(2X,I2,4X,A1,1X,F4.2,1X)
      GO TO 650
607   IF (L .NE. 8) GO TO 608
      IF (ACCS(I,J,K) .GE. 100000) GO TO 1030
      ENCODE(15,653,ID) AYIEL(I,J,K)
653   FORMAT(4X,F5.3,6X)
      GO TO 650
1030  ENCODE(15,1031,ID) AYIEL(I,J,K),MM
1031  FORMAT(4X,F5.3,5X,I1)
      GO TO 650
608   IF (ACCS(I,J,K) .GE. 100000) GO TO 1033
      GO TO 650
1033  ENCODE(15,1034,ID)
1034  FORMAT(11X,'*10',1X)
650   DECODE(15,600,ID)JD
600   FORMAT(15A1)
      ISTRT=1+(J-1)*15
      DO 651 JST=1,15
      JBUF(ISTRT)=JD(JST)
651   ISTRT=ISTRT+1
504   CONTINUE
      WRITE(7,652) (JBUF(IKA),IKA=1,120)
652   FORMAT(120A1)
502   CONTINUE
501   CONTINUE
500   CONTINUE
```

```
CALL SRCHSS(KSCLOS,0,0,2,IT,IC)
CALL SRCHSS(KSCLOS,0,0,3,IT,IC)
CALL SRCHSS(KSCLOS,0,0,4,IT,IC)
CALL SRCHSS(KSCLOS,0,0,5,IT,IC)
RETURN
END
```

What is claimed is:

1. A method of decreasing the amount of relatively long lived fission products in radioactive waste materials in excess of that due to their natural radioactive decay by producing relatively short lived radioactive nuclides and stable nuclides from said relatively long lived fission products comprising the steps of:

(a) separating said fission products into at least (1) a plurality of physically separate groups, each of said groups having at least one relatively long lived fission product nuclide selected from the group comprising $Se^{79}$, $Kr^{85}$, $Sr^{90}$, $Zr^{93}$, $Tc^{99}$, $Pd^{107}$, $Sb^{125}$, $Sn^{126}$, $I^{129}$, $Cs^{135}$, $Cs^{137}$, $Pm^{147}$, $Sm^{151}$+Eu, and actinides, and (2) relatively short lived fission product radioactive nuclides and stable nuclides;

(b) storing said relatively short lived radioactive nuclides and stable nuclides;

(c) exposing at least the groups containing $Kr^{85}$, $Sr^{90}$, $Zr^{93}$, $Tc^{99}$, $Pd^{107}$, $I^{129}$, $Cs^{135}$, $Sm^{151}$+Eu, and actinides, to a high thermal neutron flux for separate, different predetermined periods of time selected in accordance with the long lived fission product nuclide in said corresponding group for inducing predetermined transformations of said relatively long lived fission product nuclides to produce relatively short lived radioactive nuclides and stable nuclides;

(d) removing each exposed group containing said produced relatively short lived radioactive nuclides and stable nuclides from said high thermal neutron flux;

(e) separating said removed group into (1) said produced short lived radioactive nuclides and stable nuclides, and (2) a plurality of further groups having long lived fission product nuclides respectively corresponding to at least some of the long lived fission product nuclides or said plurality of groups of step (a);

(f) storing said produced short lived radioactive nuclides and stable nuclides;

(g) joining at least one of said plurality of further groups to at least one of said plurality of groups of step (a) having a corresponding long lived fission product nuclide;

(h) repeating steps (c)–(f) at least one time;

(i) for at least one other further group, maintaining same separate from said plurality of groups of step (a) while re-exposing same to a high thermal neutron flux for a predetermined period of time selected in accordance with said long lived fission product nuclide contained therein for inducing predetermined transformations of said long lived nuclide to further produce relatively short lived radioactive nuclides and stable nuclides;

(j) removing said at least one other further group containing said further produced relatively short lived radioactive nuclides and stable nuclides from said high thermal flux;

(k) separating said removed other further group into (1) said further produced short lived radioactive nuclides and stable nuclides, and (2) yet another group containing said long lived fission product nuclides of step (i);

(l) storing said further produced short lived radioactive nuclides and stable nuclides; and (m) storing said long lived radioactive nuclides of steps (e) and (k) after they have reached a reduced level of radioactivity over their natural decay.

2. A method as recited in claim 1, wherein a component comprises $Se^{79}$.

3. A method as recited in claim 1, wherein a component comprises Krypton.

4. A method as recited in claim 1, wherein a component comprises Strontium.

5. A method as recited in claim 1, wherein a component comprises $Zr^{93}$.

6. A method as recited in claim 1, wherein a component comprises $Tc^{99}$.

7. A method as recited in claim 1, wherein a component comprises $Pd^{107}$.

8. A method as recited in claim 1, wherein a component comprises $Sn^{126}$.

9. A method as recited in claim 1, wherein a component comprises $Sb^{125}$.

10. A method as recited in claim 1, wherein a component comprises Iodine.

11. A method as recited in claim 1, wherein a component comprises $Cs^{135}$.

12. A method as recited in claim 1, wherein a component comprises $Cs^{137}$.

13. A method as recited in claim 1, wherein a component comprises $Pm^{147}$.

14. A method as recited in claim 1, wherein a component comprises $Sm^{151}$.

15. A method as recited in claim 1, wherein a component comprises Europium.

* * * * *